US011808096B2

(12) United States Patent
Wijning

(10) Patent No.: US 11,808,096 B2
(45) Date of Patent: Nov. 7, 2023

(54) OFFSHORE DRILLING SYSTEM, VESSEL AND METHOD

(71) Applicant: ITREC B.V., Schiedam (NL)

(72) Inventor: Diederick Bernardus Wijning, Schiedam (NL)

(73) Assignee: ITREC B.V., Schiedam (NL)

( * ) Notice: Subject to any disclaimer, the term of this patent is extended or adjusted under 35 U.S.C. 154(b) by 44 days.

(21) Appl. No.: 17/616,887

(22) PCT Filed: Jun. 5, 2020

(86) PCT No.: PCT/EP2020/065723

§ 371 (c)(1),
(2) Date: Dec. 6, 2021

(87) PCT Pub. No.: WO2020/245426

PCT Pub. Date: Dec. 10, 2020

(65) Prior Publication Data

US 2022/0307332 A1 Sep. 29, 2022

(30) Foreign Application Priority Data

Jun. 7, 2019 (NL) ..... 2023279
Jul. 1, 2019 (NL) ..... 2023412

(51) Int. Cl.
*E21B 19/00* (2006.01)
*E21B 19/09* (2006.01)
(Continued)

(52) U.S. Cl.
CPC ..... *E21B 19/09* (2013.01); *B63B 35/4413* (2013.01); *E21B 19/006* (2013.01); *B63B 2003/147* (2013.01)

(58) Field of Classification Search
CPC ... E21B 19/006; E21B 19/09; B63B 35/4413; B63B 2003/147
See application file for complete search history.

(56) References Cited

U.S. PATENT DOCUMENTS 9,074,446 B2 * 7/2015 Kristensen ..... E21B 19/006
9,605,495 B2 * 3/2017 Reinås ..... E21B 17/07
2018/0045013 A1 * 2/2018 Stephen ..... E21B 43/01

FOREIGN PATENT DOCUMENTS

WO WO 2010/071444 A1 6/2010
WO WO 2011/034422 A2 3/2011
(Continued)

OTHER PUBLICATIONS

International Search Report for PCT/EP2020/065723 dated Aug. 3, 2020.
(Continued)

*Primary Examiner* — Matthew R Buck
(74) *Attorney, Agent, or Firm* — Birch, Stewart, Kolasch & Birch, LLP

(57) ABSTRACT

The first aspect of the present invention relates to an offshore drilling system and a method for performing subsea wellbore related activities involving a riser extending between the vessel and a subsea wellbore. The offshore drilling system comprising a drilling vessel with a floating hull, a drilling tower and a tubular string main hoisting device. A vertically mobile working deck with a rig floor slip device is positioned above the moonpool. A telescopic joint and a diverter are provided, wherein the inner barrel of the telescopic joint is secured to the diverter via a flexible joint. Furthermore an integrated heave compensation system is provided such that said travelling block and the mobile working deck move synchronously in heave compensation.

21 Claims, 21 Drawing Sheets

(51) Int. Cl.
*B63B 35/44* (2006.01)
*B63B 3/14* (2006.01)

(56) References Cited

FOREIGN PATENT DOCUMENTS

| | | | |
|---|---|---|---|
| WO | WO 2013/169099 | A2 | 11/2013 |
| WO | WO 2015/133896 | A1 | 9/2015 |
| WO | WO 2016/062812 | A1 | 4/2016 |
| WO | WO 2018/151593 | A1 | 8/2018 |

OTHER PUBLICATIONS

Search Report for NL Application No. 2023279 dated Jan. 31, 2020.
Search Report for NL Application No. 2023412 dated Mar. 11, 2020.
Written Opinion of the International Searching Authority for PCT/EP2020/065723 (PCT/ISA/237) dated Aug. 3, 2020.

* cited by examiner

OFFSHORE DRILLING SYSTEM, VESSEL AND METHOD

FIELD OF THE INVENTION

The first aspect of the present invention relates to an offshore drilling system for performing subsea wellbore related activities, e.g. drilling a subsea wellbore, comprising a drilling vessel that is subjected to heave motion due to waves.

The first aspect of the present invention also relates to methods that are performed using the offshore drilling system.

BACKGROUND OF THE INVENTION

In the art, e.g. as marketed by the present applicant, offshore drilling systems for performing subsea wellbore related activities involving a riser extending between the vessel and a subsea wellbore are known. The offshore drilling system comprises a drilling vessel with:

- a floating hull, e.g. a drilling vessel or platform, comprising a moonpool;
- a drilling tower positioned on said hull at or near the moonpool;
- a tubular string main hoisting device comprising:
  - a main hoisting winch and a main cable driven by said main hoisting winch;
  - a crown block, and
  - a travelling block suspended from said crown block via said main cable, which travelling block is adapted to suspend a tubulars string, e.g. a drill string, therefrom along a firing line through said moonpool, e.g. with an intermediate topdrive adapted to provide a rotary drive for a drill string;
- a vertically mobile working deck positioned above the moonpool and vertically movable with respect to the drilling tower along the firing line within a motion range including a heave compensation motion range;
- a rig floor slip device arranged on said mobile working deck and adapted to suspend therefrom a drilling tubulars string along the firing line through said riser to the wellbore;

the offshore drilling system further comprising:

- a telescopic joint for compensating the length of said riser, the telescopic joint comprising an outer barrel adapted to be connected to a fixed length section of the riser, and an inner barrel movable relative to the outer barrel;

the offshore drilling vessel further comprising:

- a diverter configured to divert a hydrocarbon and/or drilling mud stream flowing up through the riser; wherein the inner barrel of the telescopic joint is secured to the diverter via a flexible joint;

the offshore drilling system further comprising:

- a riser tensioning system comprising a tension ring connected to the fixed length section of the riser or to the outer barrel of the telescopic joint, and tension members connected to said tension ring and to the floating hull;

the offshore drilling vessel further comprising:

- an integrated heave compensation system configured to provide a heave compensation of the travelling block as well as of the mobile working deck, such that, in operation, said travelling block and the mobile working deck move synchronously in heave compensation.

Such an offshore vessel is disclosed in WO2016/062812 of the same applicant.

A diverter allows mud with drill cuttings returning from the well through the riser to be dumped to a mud processing system. The diverter will in practice for instance be connected to one or more mud circulation lines that lead to a mud treatment facility onboard the vessel, e.g. located within a deckbox structure. In embodiments, the diverter connects via a downward sloping mud return line to a mud treatment and circulation system. E.g., within the deckbox structure, adjacent the moonpool, a shaker room is provided and the mud passes by gravity via the downward sloping mud return line from the diverter to the shaker room. A diverter can also be used to divert gases through overboard piping to vent the riser.

In the known embodiment, the diverter with the inner barrel of the telescoping joint secured thereto is attached to the mobile working deck. In an operation modus the position of the inner and outer barrel is locked with respect to each other. Then the mobile deck has a fixed position with respect to the fixed length part of the riser. The hydraulic deck compensator allows a heave compensated motion of the working deck relative to the hull.

Also, in the known embodiment, the inner barrel of the telescoping joint is secured to the diverter with via a flexible joint, also known as flex joint, allowing gimballing of the telescopic joint. Hence, angular movement of the telescopic joint with respect to the diverter is permitted. This compensates for vessel motions. A consequence of the above-described configuration is that the telescopic joint can be in any position within a fictious cone having its apex in the flexible joint. In addition, in elevated positions of the mobile working deck, the telescopic joint extends through the moonpool.

OBJECT OF THE INVENTION

It is an object of the first aspect of the invention to provide an improved vessel. For example the first aspect of the invention aims to provide for improved wellbore pressure control during drilling of the subsea wellbore. Another aim of the first aspect of the invention is to improve the practical use of equipment as addressed above, e.g. in view of drilling project efficiency, efforts of drilling personnel, etc.

SUMMARY OF THE INVENTION

The first aspect of the present invention provides an offshore drilling vessel for performing subsea wellbore related activities, e.g. drilling a subsea wellbore. According to the first aspect of the present invention, in an operational modus the diverter is connected stationary to the floating hull and a mechanical connector is tensioned between the fixed length section of the riser or to the outer barrel of the telescopic joint on the one end, e.g. via the tension ring, and the mobile working deck.

The mechanical connector can be one or more of cable, chain, rigid link, hydraulic cylinder.

During operation, the diverter is connected to the hull, preferably to the hull adjacent to the moonpool. Advantageously, the diverter is provided at or just below a deck level of the hull.

An advantage of this configuration is that any lines between the diverter and the vessel hull, e.g. mud circulation lines, do not need to be flexible to compensate for the distinct positions of the diverter with respect to the hull.

Another advantage is that possible gases which are to be diverted are not brought above deck level.

Yet another advantage of the inventive configuration with the diverter connected to the hull is that in situations having a relatively small moonpool, the connection position of the diverter close to the moonpool results in a relatively larger fictious cone in which the gimballing telescopic joint is allowed to move compared to the relatively small fictious cone with the diverter at an elevated position above the moonpool.

Compared to the WO2016/062812 the riser is not connected to the working deck anymore. The lack of this connection would cause the working deck heave compensation to become impaired. The mechanical connector effectively replaces the former direct connection between riser and working deck so that the vertical spacing between the deck and the fixed length riser section remains constant. This connector is tensioned due to the operation of the integrated heave compensation system which effectively tends to pull the working deck upwards.

In embodiments, a diverter carrier is provided for the diverter, allowing the diverter to move between the operational position and a moonpool clearance position. Preferably, in the moonpool clearance position the diverter carrier is releasably attached to the mobile working deck, allowing the diverter to be brought in an elevated position above the moonpool.

The drilling system further comprises integrated heave compensation system configured to provide a heave compensation of the travelling block as well as of the mobile working deck, such that, in operation, said travelling block and the mobile working deck move synchronously in heave compensation. The system according to the first aspect of the invention allows to obtain a synchronous heave compensated motion of the working deck and the travelling block in a simple manner with high accuracy and reliability.

The integrated heave compensation system allows to provide synchronous heave compensation motion of the travelling block and of the working deck, whilst keeping the working deck floor fully accessible. This e.g. allows for piperacking operations to be performed between the firing line and a tubular storage rack without any hindrance.

The inventive system may be embodied so that the heave motion system is adapted to support a vertical load whilst in heave compensation motion of at least 300 metric tonnes, e.g. between 400 and 800 metric tonnes.

Advantageously, a single actuator for an active control of the heave compensation system or a single buffer for a passive control of the heave compensation system may be arranged to control both the main hoisting device and the mobile working deck.

By operation of the main hoisting winch of the hoisting device, the travelling block can be positioned independently from a position of the working deck. During a drilling process, this is in particular advantageous in a step of connecting or disconnecting a pipe length by screwing to a drill string, because the synchronous heave compensation motion obtained from the integrated heave motion system which may prevent damage to a threaded end of the pipe length.

A hydraulic connection of the deck compensator and the sheave compensator provides a fluid communication in between the compensators of the heave compensation system which results in a substantially same hydraulic pressure at both compensators. Fluctuations in hydraulic pressure caused by the heave motion of the floating body will act on both compensators, such that both compensators will move substantially synchronously.

Preferably, the deck compensator is fully arranged below the working deck. The arrangement allows to provide synchronous heave compensation motion of the travelling block and the working deck, whilst keeping the working deck floor fully accessible. This e.g. allows for pipe racking operations to be performed between the firing line and a tubular storage rack without any hindrance.

It is also conceivable that the working deck is suspended directly by rods, cables, or chains from the travelling block so that the heave compensation motion follows thereof. Well entry equipment, e.g. the coiled tubing injector head unit, is placed on the working deck. For such an operation any direct suspension device between the working deck and travelling block is ok, however, such a suspension device may limit access to the firing line, and may therefore limit the operational capability of a vessel in view of the variety of activities to be performed.

In embodiments, similar to the configuration known from WO2016/062812, the integrated heave compensation system comprises:

a main cable heave compensation sheave in a path of said main cable between said main hoisting winch and the travelling block, and wherein the heave compensation system comprises a hydraulic sheave compensator connected to said main cable heave compensation sheave to provide a heave compensated motion of the travelling block; and a hydraulic deck compensator, which hydraulic deck compensator is connected to the hull and to the mobile working deck to provide a heave compensated motion of the working deck relative to the hull within said heave compensation motion range;

wherein heave compensation system is configured such that, in operation, said hydraulic deck compensator and said hydraulic sheave compensator move synchronously in order to provide heave compensation of both the travelling block and the mobile working deck.

In an embodiment of the system according to the first aspect of the invention, the hydraulic deck compensator comprises a pair of hydraulic cylinders which are positioned at opposite sides of the firing line. Preferably, the hydraulic cylinders are positioned in a vertical plane comprising the firing line. The pair of hydraulic cylinders are spaced apart to allow for a passage of the riser section in the firing line and between said pair of hydraulic cylinders.

In an embodiment of the system according to first aspect of the invention, the hydraulic compensator is connected to an active actuator to obtain an active control of the heave compensation system. Instead of a passive control of the heave compensation system including for example a gas buffer, an active control is obtained by using the active actuator. Advantageously, the active control may contribute to a quicker responding and a more accurate heave compensation system.

In embodiments, such as known from WO2013/169099, the integrated heave compensation system comprises a heave compensation system for the travelling block and a mechanical connection between the travelling block and the mobile working deck to provide a heave compensated motion of the working deck relative to the drilling tower structure.

In embodiments, the integrated heave compensation system comprises a hydraulic main cable compensator engaging on the one or more main cables and configured to provide a heave compensated motion of the travelling block. Preferably, the integrated heave compensation system comprises a mechanical connection between the travelling block and the mobile working deck to provide a heave compensated motion of the working deck relative to the drilling tower structure, such that, in operation, said hydraulic main cable compensator provides heave compensation of both the travelling block and the mobile working deck.

In embodiments, the motion range includes a lower stationary position and wherein the heave compensation motion range lies higher than said lower stationary position. Advantageously, the system allows a drilling technique of managed pressure drilling.

In an embodiment the integrated heave compensation system comprises a hydraulic cylinder having a piston rod, wherein a main cable heave compensation sheave is connected to said piston rod. The hydraulic cylinder is connected to a hydraulic/gas separator cylinder, one chamber thereof being connected to a gas buffer as is known in the art. For example the compensator cylinder has a stroke between 5 and 15 meters, e.g. of 6 meters.

The inventive offshore drilling system preferably further comprises at least one of the following features:

- the floating body further comprising a drillers cabin deck and a drillers cabin thereon, with the lower stationary position of the working deck being at said drillers cabin deck level;
- a piper racker system provided with a heave motion synchronisation system adapted to bring a drill pipe retrieved from a drill pipe storage rack into a vertical relative motion synchronous with a relative motion of the upper end of the riser, e.g. of the working deck resting thereon, thereby allowing to interconnect the drill pipe to a drill pipe string suspended from a rig floor slip device;
- a rotating control device, e.g. above the telescopic joint and preferably below the working deck, to close off an annulus between an upper riser section and a tubular string extending through the riser, e.g. in the course of managed pressure drilling, and including at least one flowhead member to allow a connection of at least one hose for transferring an annular fluid flow to the floating body.

The first aspect of the present invention also relates to a method for performing subsea wellbore related activities involving a riser extending between the vessel and a subsea wellbore, wherein use is made of the inventive offshore drilling system.

In the offshore drilling field it is known to make use of a telescopic joint, also referred to as slip joint. The telescopic joint has a lower outer barrel and an upper inner barrel, wherein the lower outer barrel is adapted to be connected to a fixed length section of the riser extending to the subsea wellbore to the riser. In known embodiments the telescopic joint is provided with a locking mechanism, e.g. with hydraulically activated dogs, which is adapted to lock the telescopic joint in a collapsed position. Known telescopic joints provided a higher pressure rating in the collapsed and locked position than in the dynamic stroking mode. For example telescopic joints are known to have one or more metal-to-metal high pressure seals that are operative in the collapsed and locked position, whereas in dynamic mode a hydraulically activated low pressure seal or seals are operative.

The inventive offshore drilling system comprises a riser tensioning system adapted to connect a riser extending along the firing line between the subsea wellbore and the drilling vessel. Particularly, the riser tensioning system comprises a tension ring and tension members connected to said tension ring. In the offshore drilling field it is known for the tension ring of the riser tensioning system to be connected to the outer barrel of the telescopic joint, or to the fixed length section of the riser.

In an embodiment the system is provided with a riser wireline tensioning system with one or more wirelines that depend from respective wireline sheaves and connect to the tension ring that is connectable to the outer barrel of the telescopic joint. Or the riser tensioner may be a direct-acting telescopic riser tensioner with multiple telescopic tensioner legs that connect to the tension ring. Alternative systems include direct-acting riser tensioning systems, wherein multiple cylinder units directly engage on the tension ring.

WO2010/071444 discloses a floating arrangement with a riser tensioning system. The riser tensioning system is provided to maintain an approximately constant tension in the riser when the floating arrangement moves in the water. The tensioning system is here indicated as a first set of heave compensating devices. The floating arrangement further comprises a work deck which is arranged in an opening in a drill floor. The work deck can move relative to the drill floor by a second set of heave-compensating devices to keep the work deck at an approximately constant distance from the seabed.

In the field of drilling so-called closed circulation methods become increasingly attractive, e.g. in view of improved control of pressure within the wellbore, e.g. during drilling. To this end a rotating control device, RCD, is arranged, commonly between the telescopic joint and the flex joint, to close of the annulus between an upper riser section and the tubular string extending through the riser. One or more flowhead members below the RCD, or integrated therewith, allow for connection of one or more hoses so that annular fluid flow, e.g. return mud, can be transferred to the vessel. Due to the sealing of the annulus by the RCD control of fluid pressure in the annulus is possible, e.g. in view of techniques such as Managed Pressure Drilling.

The offshore drilling system comprises a drilling tower positioned at or near a moonpool of a floating body, e.g. a drilling vessel or platform. The tower can be a embodied as a conventional derrick, a so-called multipurpose tower as commercially available from the applicant, or any other type of tower, e.g. a two-legged tower. In an embodiment the tower is a mast having a top and a base, the base adjacent the moonpool. Optionally, one or more hydraulic cylinders of the heave motion compensator system is/are arranged within said mast, e.g. in vertical orientation therein. Preferably, a hydraulic sheave compensator of the heave compensation system is arranged within said drilling tower e.g. in a vertical orientation therein.

Preferably, the vessel according to the first aspect of the invention is a mono-hull vessel with the moonpool extending through the design waterline of the vessel. In another embodiment, for example, the vessel is a semi-submersible vessel having submergible pontoons with columns thereon that support an above-waterline deck box structure. The moonpool may then be arranged in the deck box structure.

The drilling system comprises a tubular string main hoisting device, the tubular string for example being a drill string. The main hoisting device comprises a main hoisting winch and a main cable driven by said winch, e.g. connected to said winch. The hoisting device further comprises a crown block, preferably mounted on said drilling tower, and a travelling block suspended from said crown block via said main cable, preferably in a multiple fall arrangement of said main cable. The travelling block is adapted to suspend a tubular string, e.g. a drill string, therefrom along a firing line, e.g. with an intermediate topdrive adapted to provide a rotary drive for a drill string.

In an embodiment of the system according to the first aspect of the invention, the main hoisting device comprises a first main hoisting winch and a second main hoisting winch, wherein the main cable is connected at either end thereof to a respective one of the first and second main hoisting winches. This e.g. allows for redundancy of the winches in the main hoisting device.

In such an embodiment, the first heave motion compensation system possibly comprises a first main cable heave compensation sheave in the path between the first main hoisting winch and the travelling block, a first hydraulic compensator connected to said first main cable heave compensation sheave, and a second main cable heave compensation sheave in the path between the second main hoisting winch and a travelling block, a second hydraulic compensator being connected to said second main cable heave compensation sheave.

The drilling system further comprises a vertically mobile working deck positioned above the moonpool and vertically movable with respect to the drilling tower along the firing line within a motion range including a heave compensation motion range.

As is preferred the working deck has an opening therein that is aligned with the firing line, the opening being dimensioned to at least allow for passage of the tubular string that extends into and through the riser.

As is preferred the working deck is provided with a tubular string suspension device, e.g. a device known as a rig floor slip device in the drilling field.

The working deck may be provided with a rotary table.

A rig floor slip device is arranged on said mobile working deck. The rig floor slip device is adapted to suspend therefrom a drilling tubulars string along the firing line through said riser to the wellbore.

In an embodiment of the system according to first aspect of the invention, the system further comprises a pipe racker system provided with a heave motion synchronisation system adapted to bring a drill pipe length retrieved from a drill pipe storage rack into a vertical relative motion synchronous with a relative motion of the upper end of the riser, e.g. of the working deck resting thereon, thereby allowing to interconnect the drill pipe to a drill pipe string suspended from a rig floor slip device.

In an embodiment the vessel is provided with a drilling pipes storage rack, e.g. a carousel, adapted for storage of drill pipes in vertical orientation therein, the drill pipe storage rack being mounted on the hull so as to be subjected to heave motion along with the hull. A pipe racker system is preferably that is adapted to move a pipe section between the drill pipe storage rack and a position in the firing line between the working deck and the travelling block. A rig floor slip device is provided that supports the suspended drill string within the riser when the drill string is disconnected from the travelling block, e.g. from the topdrive, in view of the connection of a new drill pipe to the suspended drill string.

Advantageously, this pipe racker system is provided with a heave motion synchronization system that is adapted to bring a drill pipe retrieved from the drill pipe storage rack into a vertical motion synchronous with the heave motion of the suspended drill string relative to the hull of the vessel in the collapsed and locked position of the telescopic joint. If a vertically mobile working deck is provided, it is deemed advantageous if the slip device is mounted on or in said working deck, with the deck being in heave motion, e.g. as it rests on the top end of the riser.

The above pipe racker system thus allows for drilling operations to be performed with the top end of the riser and the drill string slip device, possibly also a working deck supporting the slip device, in heave motion relative to the hull of the vessel. This allows said drilling operation to be performed with the telescopic joint locked, and e.g. allows for the use of an RCD device to seal the annulus and therefor obtain a controlled pressure within the riser, e.g. in view of Managed Pressure Drilling.

In embodiment the vessel is provided with an iron roughneck device arranged on the vertically mobile working deck. This e.g. allows the use of the iron roughneck deck for make-up or break-up of the threaded connection between drill pipes or other tubular bodies.

In an alternative embodiment the vessel has an iron roughneck device that is not mounted on the working deck, but is instead independently supported from the hull of the vessel, e.g. vertically mobile along a rail mounted to the tower by means of a vertical drive. The iron roughneck device is then provided with a heave motion vertical drive adapted to move the iron roughneck device in heave motion in synchronicity with the heave motion of the suspended drill string, so that the iron roughneck device can operate whilst in heave motion.

The heave motion compensating pipe racker system can be used to move drill pipes, e.g. single, double or triple pipe stands, between the drill pipe storage rack and the firing line so as to connect a new drill pipe to the pipe string held by the slip device whilst in heave motion.

It is envisaged that this may be of great value for managed pressure drilling wherein highly accurate control of borehole pressure is desired.

In an embodiment of the floating body according to the first aspect of the invention, the floating body further comprises a drillers cabin deck and a drillers cabin thereon. Preferably, the lower stationary position of the working deck being at said drillers cabin deck level.

Further, the first aspect of the invention relates to a method for drilling a subsea wellbore, wherein use is made of a system according to the first aspect of the invention.

According to a second aspect, the present invention relates to an offshore drilling system for performing subsea wellbore related activities, e.g. drilling a subsea wellbore, comprising a floating drilling vessel that is subjected to heave motion due to waves.

The second aspect of the present invention also relates to a floating drilling vessel adapted for use in the system and to methods that are performed using the system.

In the art, e.g. as marketed by the present applicant, offshore drilling vessels are known that comprise:

- a floating hull comprising a moonpool;
- a drilling tower positioned on said hull at or near the moonpool;
- a tubular string main hoisting device comprising:
  - a main hoisting winch and a main cable driven by said main hoisting winch;
  - a crown block;
  - a travelling block suspended from said crown block via said main cable, which travelling block is adapted to suspend a tubulars string therefrom along a firing line extending through said moonpool;
- a vertically mobile working deck positioned above the moonpool and vertically movable with respect to the drilling tower along the firing line within a motion range including a heave compensation motion range;

a mobile working deck support cylinder, which support cylinder is connected to the vessel and to the mobile working deck to vertically move the working deck relative to the vessel, within the motion range including the heave compensation motion range, a heave compensation system configured to provide heave compensation of the travelling block as well as of the mobile working deck, the heave motion compensation system comprising:

a heave compensation cylinder, which heave compensation cylinder is connected to a gas buffer for providing the main hoisting device with passive heave compensation; and a sheave head, comprising one or more sheaves engaging the main cable of the main hoisting device, wherein the sheave head is supported by a piston of the heave compensation cylinder for movement along a heave compensation trajectory;

wherein the mobile working deck support cylinder is hydraulically connected with the heave compensation cylinder of the heave compensation system, such that in operation the mobile working deck support cylinder moves synchronously with the heave compensation cylinder of the heave compensation system, and thus the mobile working deck moves synchronously with the travelling block.

The advantage of linking the support cylinder of the mobile working deck with the heave compensation cylinder of the tubular string main hoisting device is that, during heave compensation, the relative position of the mobile working deck and the crown block of the main hoisting device are synchronous. Thus, such a system allows for a more accurate and more efficient heave compensation system. Furthermore, while both the crown block and the mobile working deck are in synchronic heave compensation, the main hoisting winch can be used to position the crown block relative to the mobile working deck.

For example WO2016/062812 discloses such a vessel. The disclosed system allows for a synchronous heave compensated motion of the working deck and the travelling block in a simple manner with high accuracy and reliability. By operation of the main hoisting winch of the hoisting device, the travelling block can be positioned independently from a position of the working deck.

Also, it is known to provide such systems, more in particular the hydraulic compensator of such a system with an active actuator to obtain an active control of the heave compensation system. Instead of a passive control of the heave compensation system including for example a gas buffer, an active control is obtained by using the active actuator. The active control may contribute to a quicker responding and a more accurate heave compensation system.

For example, from WO2018/151593 it is known to provide the heave compensation cylinder of a heave compensation system with an adjustment system to contribute to a quicker responding and a more accurate heave compensation system. The adjustment system is configured to compensate, i.e. to improve the heave compensation provided by the cylinder. For example, by providing a pulling force on the cylinder, a delay in movement of the cylinder and/or a lack in amplitude of the cylinder can be reduced or even corrected.

Typically, an adjusting winch used in such a system is small and agile, e.g. more responsive, compared to a hoisting winch. A smaller winch requires less power to run and allows for more accurate compensation due to the smaller inertia of the motor. Another benefit is that there is less wear and tear of the wire (e.g. no drum crushing) compared with an active winch system employing the hoisting winch for providing heave compensation.

It is an object of the second aspect of the invention to provide an alternative offshore drilling system, preferably provide an offshore drilling system in which one or more of the above mentioned drawbacks are eliminated or reduced. It is a further object of the second aspect of the invention to improve the practical use of equipment as addressed above, e.g. in view of drilling project efficiency, efforts of drilling personnel, etc. A further aim of the second aspect of the invention is to provide an accurate heave compensation system, preferably with an alternative, preferably a more efficient, control over the positioning of the mobile deck.

The present invention provides an offshore drilling system for performing subsea wellbore related activities involving a riser extending between a vessel and a subsea wellbore according to claim 12.

According to the second aspect of the invention, the offshore drilling system comprises:

a floating hull comprising a moonpool;

a drilling tower positioned on said hull at or near the moonpool;

a tubular string main hoisting device comprising:

a main hoisting winch and a main cable driven by said main hoisting winch;

a crown block;

a travelling block suspended from said crown block via said main cable, which travelling block is adapted to suspend a tubulars string, therefrom along a firing line extending through said moonpool;

a vertically mobile working deck positioned above the moonpool and vertically movable with respect to the drilling tower along the firing line within a motion range including a heave compensation motion range;

a mobile working deck support cylinder, which support cylinder is connected to the vessel and to the mobile working deck to vertically move the working deck relative to the vessel, within the motion range including the heave compensation motion range, a heave compensation system configured to provide heave compensation of the travelling block as well as of the mobile working deck, the heave motion compensation system comprising:

a heave compensation cylinder, which heave compensation cylinder is connected to a gas buffer for providing the main hoisting device with passive heave compensation; and a sheave head, comprising one or more sheaves engaging the main cable of the main hoisting device, wherein the sheave head is supported by a piston of the heave compensation cylinder for movement along a heave compensation trajectory;

wherein the mobile working deck support cylinder is hydraulically connected with the heave compensation cylinder of the heave compensation system, such that in operation the mobile working deck support cylinder moves synchronously with the heave compensation cylinder of the heave compensation system, and thus the mobile working deck moves synchronously with the travelling block; and a mobile working deck dynamic positioning system, for moving the mobile working deck along the firing line within the motion range including the heave compensation motion range, wherein the mobile working deck positioning system comprises:

a positioning winch with an associated positioning cable;

a control device, which control device is adapted to control the speed of the positioning winch; and one or more sheaves, the sheaves guiding the positioning cable in a loop along the heave compensation trajectory, wherein the positioning cable is connected to the piston of the heave compensation cylinder and/or the sheave head of the heave compensation cylinder, such that the positioning winch can pull the piston of the heave compensation cylinder in opposite directions along the heave compensation trajectory and, and thus position the mobile working deck with, i.e. using, the mobile working deck support cylinder that is hydraulically connected to the heave compensation cylinder.

According to the second aspect of the invention, the mobile working deck dynamic positioning system is configured to position the heave compensation cylinder at, and hold the heave compensation cylinder in, predetermined positions along the heave compensation trajectory, and thus to position the mobile working deck at, and hold the mobile working deck in, predetermined positions along the heave motion compensation range, preferably along the motion range of the mobile working deck.

It is submitted that the mobile working deck dynamic positioning system controls the position of the mobile working deck via direct control over the heave compensation cylinder, and not via direct control over the mobile working deck support cylinder, or by using a connector cable.

The mobile working deck positioning system thus allows for the mobile working deck to be moved and positioned relative to the vessel The second aspect of the invention thus provides an alternative offshore drilling system, more in particular improves the practical use of equipment of the system, e.g. in view of drilling project efficiency, efforts of drilling personnel, etc.

Furthermore, the second aspect of the invention thus provides an accurate heave compensation system, and an alternative, more efficient, control over the positioning of the mobile deck.

In an embodiment, the control device of the mobile working deck positioning system is connected with, and configured to control, the main hoisting winch, to enable the control device to use the main hoisting system to position and/or move the travelling block while pulling the rod of the heave compensation cylinder, e.g. to keep the travelling block in a particular position relative to the vessel while moving the rod of the heave compensation system to move the mobile working deck relative to the vessel.

The mobile working deck positioning system is thus configured to also control the position of the travelling block, in particular to control the position of the travelling block relative to the mobile working deck, while moving the mobile working deck relative to the vessel Thus, in such an embodiment, the mobile working deck dynamic positioning system is configured to control the main hoisting winch to compensate for the movement of the heave compensation cylinder, such that the travelling block stays in a fixed positon relative to the vessel, while the mobile working deck dynamic positioning system moves the heave compensation cylinder, more in particular moves the sheave head of the heave compensation cylinder.

In an embodiment, the dynamic positioning system is configured to adjust passive heave compensation of the travelling block as well as of the mobile working deck by increasing and/or lowering the speed at which the piston of the heave compensation cylinder moves along the heave compensation trajectory while the heave compensation system provides passive heave compensation.

The dynamic positioning system is thus configured to tune the passive heave compensation provided by the heave compensation system, preferably provide more accurate heave compensation system.

Furthermore, the dynamic positioning system can thus be used to switch between a condition in which a load supported by the mobile working deck or the travelling block is heave compensated to a condition in which the that load is not compensated for heave compensation, by adjusting the controlled heave compensation. For example, by gradually reducing the provided heave compensation, i.e. by slowing down the movement of the heave compensation cylinder, the system can switch between a condition in which a load supported by the mobile working deck or the travelling block is heave compensated to a condition in which the that load is not compensated for heave compensation.

In an embodiment, the dynamic positioning system is configured is adapted to register and/or predict heave, e.g. relative to the sea floor, and is configured to provide active heave compensation of the travelling block as well as of the mobile working deck by pulling the piston of the heave compensation cylinder in opposite directions along the heave compensation trajectory.

Thus the mobile working deck dynamic positioning system is configured to not only control the position of the mobile working deck, but also allows for providing the mobile working deck and the travelling block with heave compensation, in particular active heave compensation. Thus, according to the second aspect of the invention, the mobile working deck dynamic positioning system allows for example for lifting a riser relative to the sea floor using the mobile working deck supporting the riser, by lifting the mobile working deck relative to the vessel while providing the mobile working deck with active heave compensation relative to the vessel.

Furthermore, the second aspect of the invention thus provides a dynamic control system that is configured to provide active heave compensation, via the heave compensation cylinder, while the travelling block and the mobile working deck are not supporting a riser, i.e. are not under a load. It is submitted that this requires a much more powerful winch compared to the prior art, in which the winch is only configured to tune the movement of the heave compensation cylinder.

In a further embodiment, the mobile working deck dynamic positioning system is configured to control the main hoisting winch to compensate for the movement of the heave compensation cylinder while the main hoist provides active heave compensation. Thus, the travelling block is heave compensated relative to the vessel using the main winch, while the mobile working deck dynamic positioning system moves the heave compensation cylinder, more in particular moves the sheave head of the heave compensation cylinder, to adjust the position of the mobile working deck relative to the vessel. Thus, the position of the mobile working deck can be adjusted without interfering with the active heave compensation provided for the travelling block by the main winch.

In an embodiment, the system is configured to block the hydraulic communication between the heave compensation cylinder and the mobile working deck support cylinder, e.g. by providing one or more blocking valves in a hydraulic circuit connecting the mobile working deck cylinder with the heave compensation cylinder, to enable the mobile working deck positioning system to move the travelling block only, e.g. to provide only the travelling block with heave compensation.

In an embodiment the system is provided with a vertically mobile working deck that is vertically mobile within a motion range including a lower stationary position, wherein the working deck is used as stationary drill floor deck with the slip joint unlocked, and the motion range further including a heave compensation motion range that lies higher than said lower stationary position. In this heave compensation motion range the working deck can perform heave compensation motion relative to the hull of the vessel.

Advantageous embodiments of the system according to the first and second aspect of the invention and the method according to the first and second aspect of the invention are disclosed in the sub claims and in the description, in which the first and second aspect of the invention are further illustrated and elucidated on the basis of a number of exemplary embodiments, of which some are shown in the schematic drawing.

Whilst primarily presented for illustrative purposes with reference to one or more of the figures, any of the technical features addressed below may be combined with any of the independent claims of this application either alone or in any other technically possible combination with one or more other technical features.

It will be appreciated that the benefits of the diverter and mechanical connector, the latter being tensioned between the fixed length section of the riser or to the outer barrel of the telescopic joint on the one end and the mobile working deck, as discussed above are applicable to the second aspect of the invention. Equally all embodiments as discussed herein of the diverter and mechanical connector, as well as each and every other technical feature addressed with reference to the first aspect of the present invention can be combined, e.g. in various combinations of such features, with the mobile working deck dynamic positioning system according to the second aspect of the invention.

For example, in an embodiment, the invention provides an offshore drilling system for performing subsea wellbore related activities involving a riser extending between a vessel and a subsea wellbore, the offshore drilling system comprising a drilling vessel with:

a floating hull comprising a moonpool;

a drilling tower positioned on said hull at or near the moonpool;

a tubular string main hoisting device comprising:

a main hoisting winch and a main cable driven by said main hoisting winch;

a crown block;

a travelling block suspended from said crown block via said main cable, which travelling block is adapted to suspend a tubulars string, therefrom along a firing line extending through said moonpool;

a vertically mobile working deck positioned above the moonpool and vertically movable with respect to the drilling tower along the firing line within a motion range including a heave compensation motion range;

a mobile working deck support cylinder, which support cylinder is connected to the vessel and to the mobile working deck to vertically move the working deck relative to the vessel, within the motion range including the heave compensation motion range, a rig floor slip device arranged on said mobile working deck and adapted to suspend therefrom a drilling tubulars string along the firing line through said riser to the wellbore;

the offshore drilling system further comprising:

a telescopic joint for compensating the length of said riser, the telescopic joint comprising an outer barrel adapted to be connected to a fixed length section of the riser, and an inner barrel movable relative to the outer barrel;

the offshore drilling vessel further comprising:

a diverter configured to divert a hydrocarbon and/or drilling mud stream flowing up through the riser; wherein the inner barrel of the telescopic joint is secured to the diverter via a flexible joint;

the offshore drilling system further comprising:

a riser tensioning system comprising a tension ring connected to the fixed length section of the riser or to the outer barrel of the telescopic joint, and tension members connected to said tension ring and to the floating hull;

the offshore drilling vessel further comprising:

an integrated heave compensation system configured to provide a heave compensation of the travelling block as well as of the mobile working deck, the heave compensation system comprising:

a heave compensation cylinder, which heave compensation cylinder is connected to a gas buffer for providing the main hoisting device with passive heave compensation; and a sheave head, comprising one or more sheaves engaging the main cable of the main hoisting device, wherein the sheave head is supported by a piston of the heave compensation cylinder for movement along a heave compensation trajectory;

wherein the mobile working deck support cylinder is hydraulically connected with the heave compensation cylinder of the heave compensation system, such that in operation the mobile working deck support cylinder moves synchronously with the heave compensation cylinder of the heave compensation system, and thus the mobile working deck moves synchronously with the travelling block, a mobile working deck dynamic positioning system, for moving the mobile working deck along the firing line within the motion range including the heave compensation motion range, wherein the mobile working deck positioning system comprises:

a positioning winch with an associated positioning cable;

a control device, which control device is adapted to control the speed of the positioning winch; and one or more sheaves, the sheaves guiding the positioning cable in a loop along the heave compensation trajectory, wherein the positioning cable is connected to the piston of the heave compensation cylinder and/or the sheave head of the heave compensation cylinder, such that the positioning winch can pull the piston of the heave compensation cylinder in opposite directions along the heave compensation trajectory and, and thus position the mobile working deck with the mobile working deck support cylinder that is hydraulically connected to the heave compensation cylinder; and wherein, in an operational modus:

the diverter is connected stationary to the floating hull;

a mechanical connector is tensioned between the fixed length section of the riser or to the outer barrel of the telescopic joint on the one end, e.g. via the tension ring, and the mobile working deck.

In such an embodiment, the mechanical connector provides a connection between riser and mobile working deck so that the vertical spacing between the mobile working deck and the fixed length riser section remains constant. The mobile working deck is thus heave compensated.

The connector is tensioned due to the operation of the integrated heave compensation system, in this embodiment by the hydraulically connected mobile working deck support cylinder and heave compensation cylinder, which cylinders act as a springs that effectively tend to pull the working deck upwards.

The hydraulic connection between travelling block, more in particular the heave compensation cylinder, and mobile working deck, more in particular the mobile working deck support cylinder, automatically synchronizes the motion of the travelling block and the motion of the mobile working deck. The mobile working deck and travelling block can thus be kept stationary above the seabed by means of a mechanical connection with the riser in combination with the pressurized heave compensation cylinder, and the hydraulically connected mobile working deck support cylinder, acting as a springs.

As an alternative, the mobile working deck dynamic positioning system can be used to provide active heave compensation, and thus keep the vertical spacing between the mobile working deck and the fixed length riser section without the mechanical connector. In such a configuration, preferably the nitrogen pressurized heave compensation cylinder carries 80-90% of the load and the positioning winch of the dynamic positioning system carries the remaining 10-20% of the load. Therefore the positioning winch consumes only a fraction of the power of actively heave compensated drawworks.

Also, the mobile working deck dynamic positioning system can thus be used to keep the mobile working deck at a constant distance to the riser, to enable applying or removing the mechanical connection between the riser and the mobile working deck.

The aspects of the first aspect of the invention will now be explained with reference to the drawings. In the figures relating to the second aspect of the invention, components corresponding in terms or construction and/or function are provided with the same last two digits of the reference numbers. In the drawings:

DETAILED DESCRIPTION OF EMBODIMENTS

With reference to the drawings an example of an offshore drilling system for performing subsea wellbore related activities involving a riser extending between the vessel and a subsea wellbore according to the first aspect of the invention will be discussed.

Figure 1:
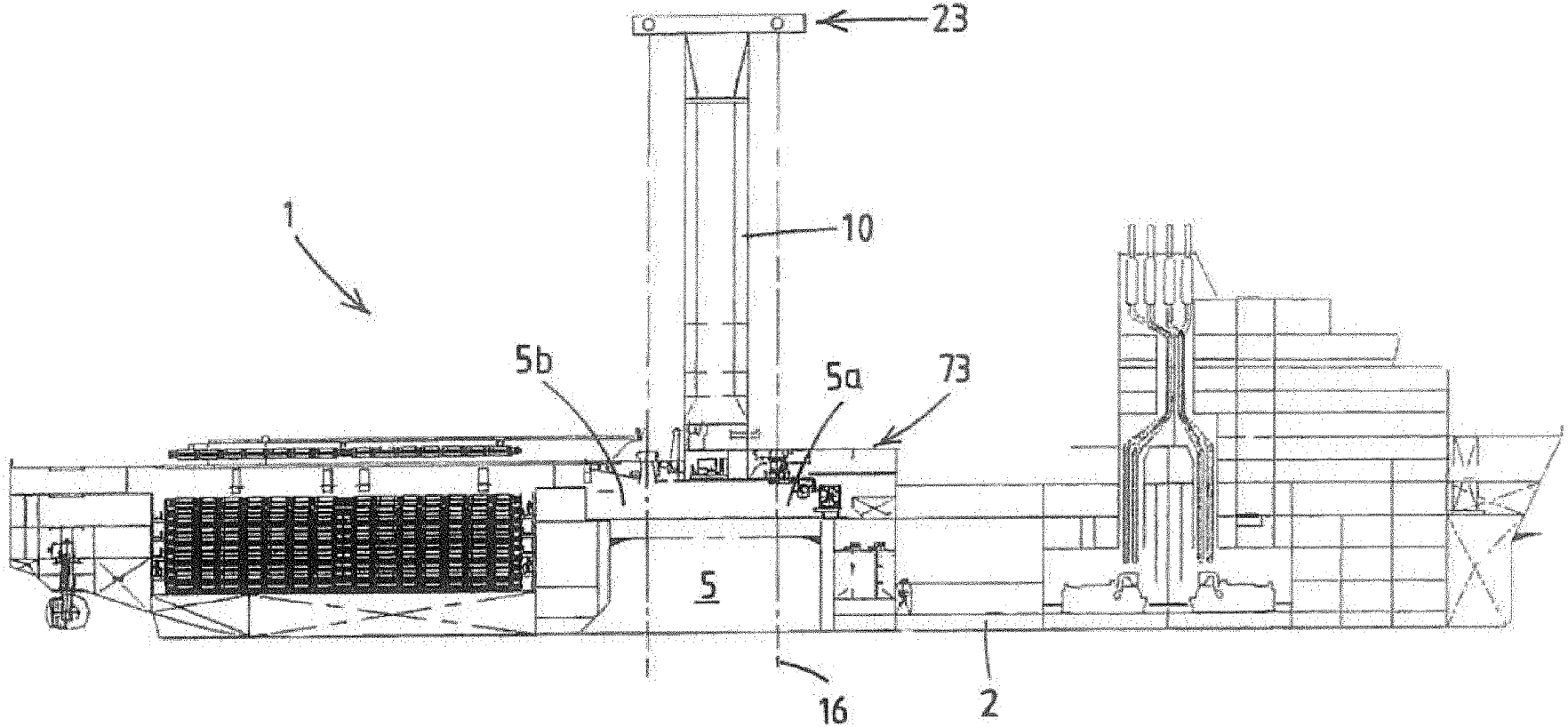
FIG. 1 shows schematically in vertical cross-section a drilling vessel according to the first aspect of the invention.
Figure 2:
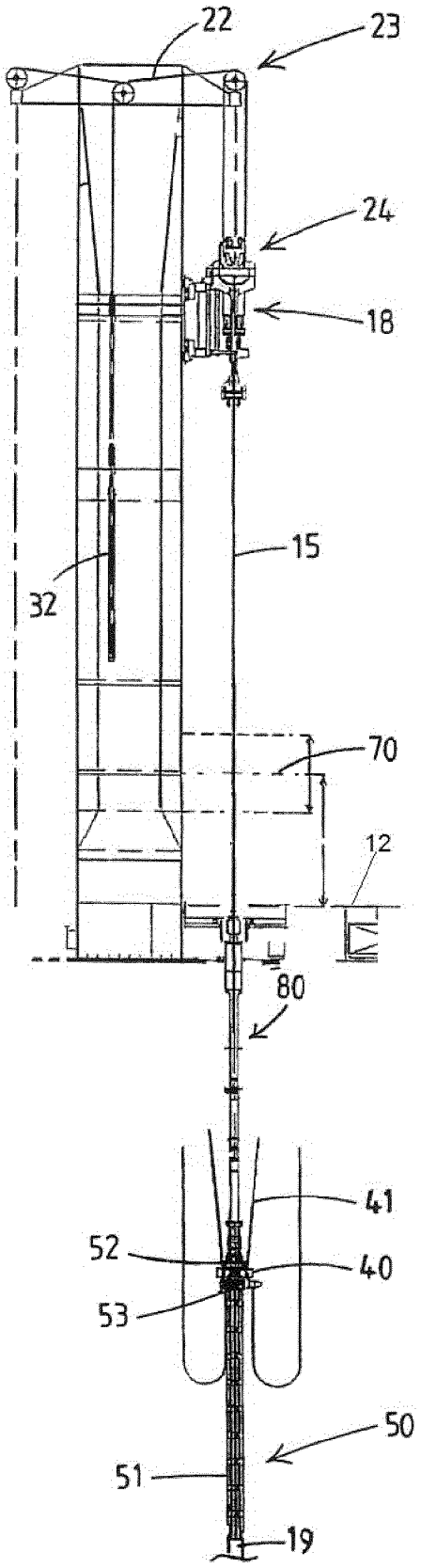
FIG. 2 shows a portion of the vessel with the drilling mast with a compensator cylinder therein and a mobile working deck, as well as a telescopic joint.

As shown in FIG. 1 and FIG. 2, the system comprises a drilling vessel 1 having a floating hull 2 subjected to heave motion, the hull comprising a moonpool 5, here the moonpool having a fore portion 5*a* and an aft portion 5*b*. The hull has a main deck 12.

As is preferred the vessel 1 is a mono-hull vessel with the moonpool extending through the design waterline of the vessel. In another embodiment, for example, the vessel is a semi-submersible vessel having submergible pontoons (possibly an annular pontoon) with columns thereon that support an above-waterline deck box structure. The moonpool may then be arranged in the deck box structure.

The vessel is equipped with a drilling tower 10 at or near the moonpool. In this example, as is preferred, the tower is a mast having a closed outer wall and having a top and a base. The base of the mast is secured to the main deck 12 of the hull 2. In this example the mast is mounted above the moonpool 5 with the base spanning the moonpool in transverse direction.

In another embodiment the tower 10 can be embodied as a derrick, e.g. with a latticed derrick frame standing over the moonpool.

The vessel 1 is provided with a tubular string main hoisting device, the tubular string for example being a drill string 15.

Figure 3:
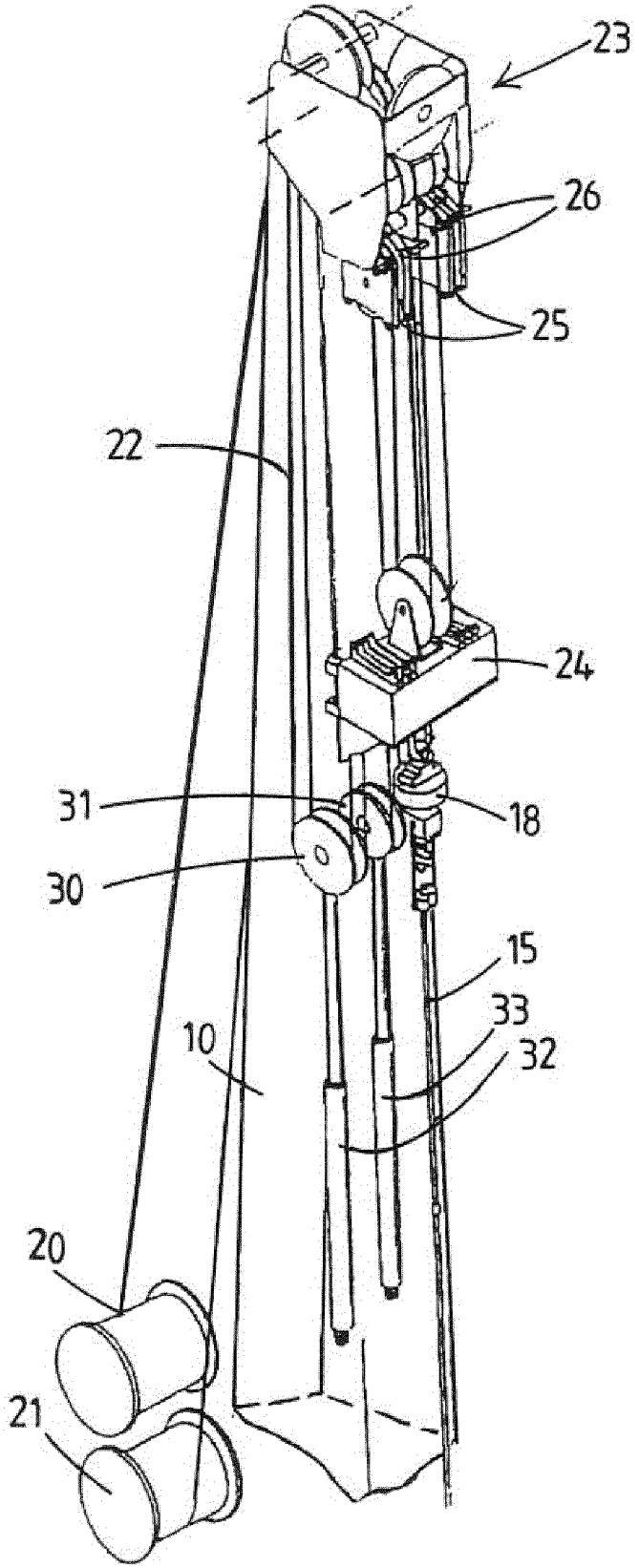
FIG. 3 shows in a perspective view a main hoisting device provided with a heave compensation system including two sheave compensators.
Figure 4:
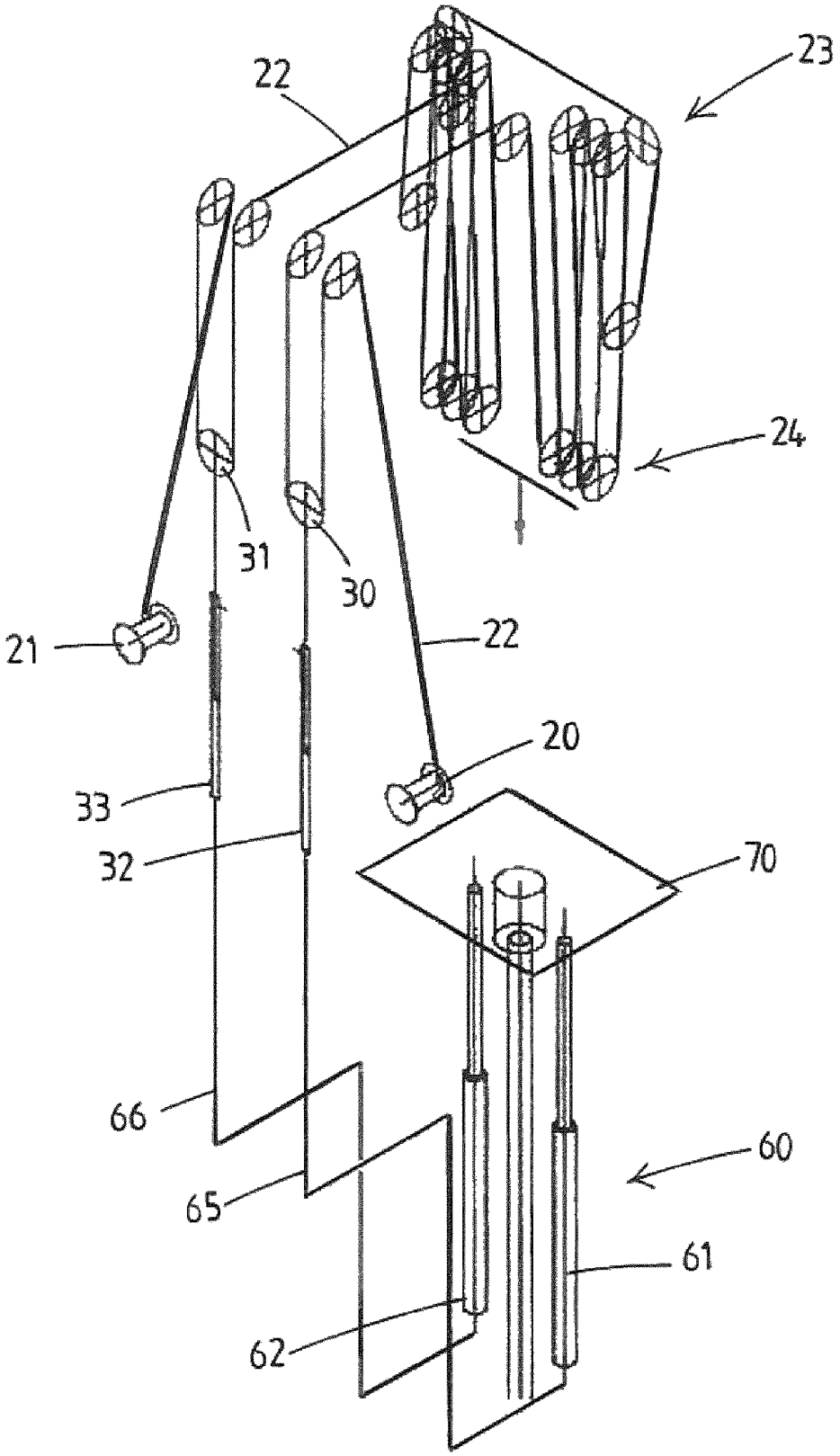
FIG. 4 shows in a perspective view the heave motion system according to the first aspect of the invention, wherein a sheave compensator is hydraulically connected to a deck compensator.

The main hoisting device is further illustrated in FIG. 3 and FIG. 4.

The shown configuration of the main hoisting device comprises:

- a main hoisting winch, here first and second winches 20, 21, and a main cable 22 that is driven, and here connected to said winches 20, 21,
- a crown block 23, here at the top end of the mast 10, and a travelling block 24 that is suspended from the crown block 23 in a multiple fall arrangement of the main cable 22.

As shown in FIG. 3 one or more main cable sheaves connected to the travelling block 24 have an individual lower latching device 25 allowing to connect and disconnect the individual sheave to and from the travelling block 24. Preferably these one or more sheaves also have an upper latching device 26 allowing to latch the sheave to the crown block if the sheave is disconnected from the travelling block. This "splittable block" arrangement is known in the art.

The travelling block 24 is adapted to suspend a tubular string, e.g. the drill string 15, therefrom along a firing line 16, here shown (as preferred) with an intermediate topdrive 18 that is supported by the travelling block 24 and that is adapted to provide a rotary drive for the drill string.

FIG. 3 shows in a schematic view, the main hoisting device which comprises a first main hoisting winch 20 and the second main hoisting winch 21, wherein the main cable 22 is connected at either end thereof to a respective one of the first and second main hoisting winches 20,21.

The vessel 1 of the shown embodiment is provided with a heave compensation system adapted to provide heave compensation of the travelling block 24. This heave compensation system comprises a main cable heave compensation sheave, here two sheaves 30,31, one each in the path between each of the main hoisting winches 20, 21 and the travelling block 24. These sheaves 30, 31 are each connected to a passive and/or active heave motion compensator device, here including hydraulic cylinders, also called sheave compensators 32, 33, which are each connected to a respective main cable heave compensation cable sheave 30, 31.

In the shown embodiment each sheave compensator comprises a hydraulic cylinder having a piston rod, the main cable heave compensation sheave 30,31 being connected to said piston rod. For example the compensator cylinders 32, 33 each have a stroke between 5 and 15 meters, e.g. of 6 meters. Preferably, the cylinders 32, 33 are mounted within the mast in vertical orientation. FIG. 3 shows the lengthy cylinders 32, 33 including a fully extended position of the piston rods thereof which are preferably mounted vertically within the mast 10.

As shown in FIG. 4, the heave compensation system is arranged to provide heave compensation of the travelling block 24 of the main hoisting device, but also to provide heave compensation of a mobile working deck 70. The mobile working deck 70 is positioned above the moonpool 5. The working deck 70 comprises equipment, like a rig floor slip device, to carry out operational steps to a tubular string, in particular a drill string 15.

In the shown configuration, the mobile working deck 70 is supported by a deck compensator. The deck compensator is connected to the vessel 1 and the mobile working deck 70. The deck compensator comprises at least one double acting hydraulic cylinder, here two hydraulic cylinders 61, 62 which are positioned below the mobile working deck. The hydraulic cylinders 61, 62 are positioned opposite each other. The hydraulic cylinders 61, 62 are positioned at opposite sides of the firing line 16. Here, the firing line 16 and the two hydraulic cylinders 61, 62 are positioned in a common plane which is oriented in a vertical direction. Advantageously, the arrangement of the deck compensator including two hydraulic cylinders 61, 62 contribute to the accessibility of the area below the working deck 70. The deck compensator e.g. allows access to the area for drilling equipment or a guidance of conduits.

As shown in FIG. 4, the sheave compensator 32, 33 and the deck compensator 60 are hydraulically interconnected by a hydraulic conduit 65, 66. The first hydraulic sheave cylinder 32 is hydraulically connected via the first hydraulic conduit 65 to the first hydraulic deck cylinder 61 and the second hydraulic sheave cylinder 33 is hydraulically connected via the hydraulic conduit 66 to the second hydraulic deck cylinder 62. Advantageously, the hydraulic interconnection of the sheave compensator and the deck compensator provides a synchronous compensated heave motion of both the travelling block 24 and the working deck 70.

The mobile working deck 70 is movable with respect to the vessel 1, in particular the drilling tower 10, along the firing line 16 within a motion range including a heave compensation motion range 72. The motion range is further illustrated and explained hereafter with reference to FIGS. 8 and 10.

As shown in FIGS. 2, 7*a*, 7*b*, 8 and 10, the vessel is furthermore provided with a riser tensioning system that is adapted to connect to a riser 19 extending along the firing line 16 between a subsea wellbore, e.g. a BOP on the subsea wellhead, and the vessel 1. The riser tensioning system comprises a tension ring 40 and tensioner members 41 connected to the tension ring 40. In the depicted example a wire line tensioning system is shown, with the members 41 being wires that run from the ring 40 upward to sheaves 42 and then to a tensioning arrangement, e.g. including cylinders 43 and a gas buffer.

The drawings further show the presence of a telescopic joint 50 having a lower outer telescopic joint barrel 51 and an upper inner telescopic joint barrel 52. As is known in the art the outer barrel 51 is adapted to be connected at its lower end, e.g. via bolts, to a fixed length section of the riser 19 extending to the seabed. As is known in the art and not shown in detail here the telescopic joint is provided with a locking mechanism 53, e.g. including hydraulically activated locking dogs, which is adapted to lock the telescopic joint in a collapsed position. As explained in the introduction the telescopic joint has a higher pressure rating when collapsed and locked that in dynamic stroking mode, e.g. as the locked position includes an operative metal-to-metal seal in the telescopic joint.

As is known in the art the tension ring 40 of the riser tensioning system is adapted to be connected to the outer barrel 51 of the telescopic joint 50, thereby allowing to absorb the effective weight of the riser.

Figure 5:
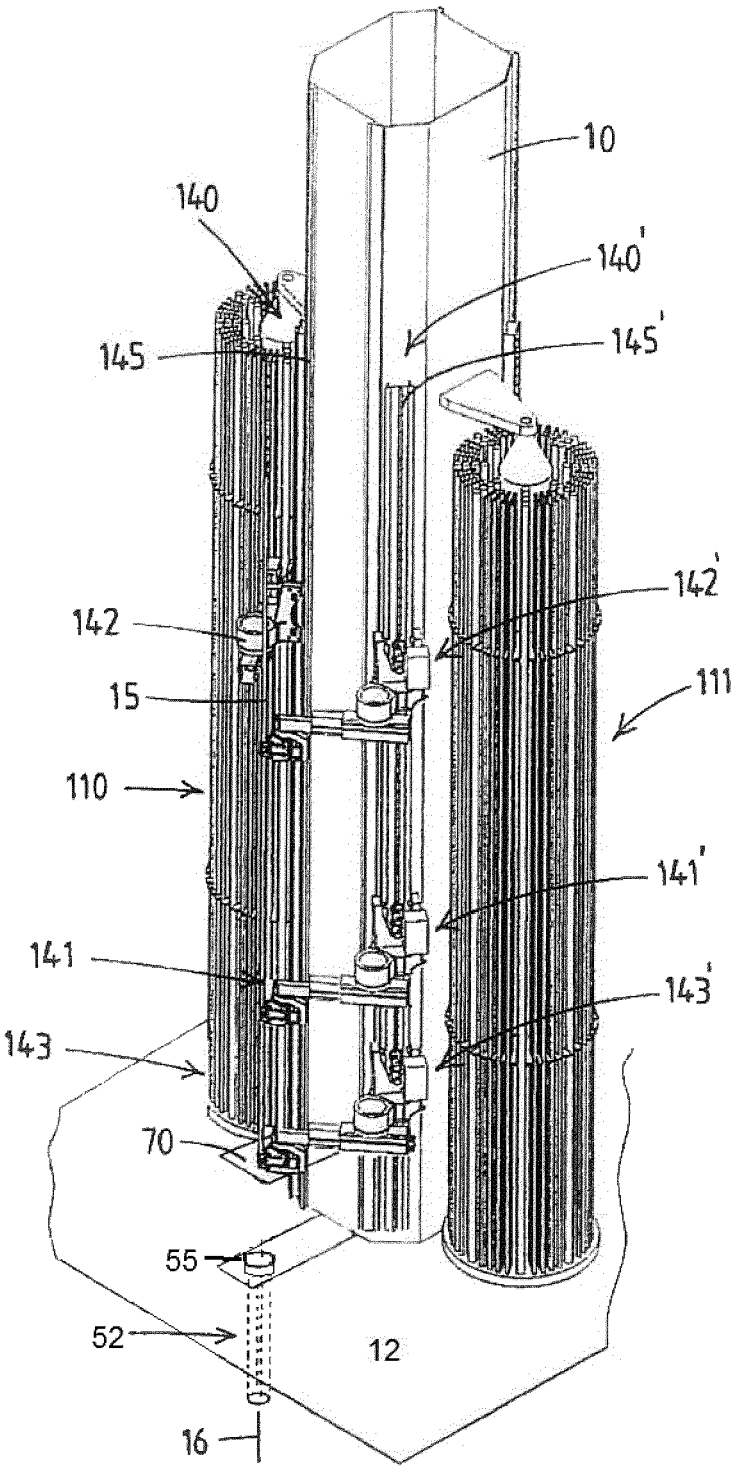
FIG. 5 illustrates the mast of the vessel of FIG. 1, with a mobile working deck, the mast being provided with a vertical rails whereon two mobile pipe racker arm units and a mobile iron roughneck device are mobile in heave compensation mode, and with pipe storage carousels mounted on the hull.

In FIG. 5 a diverter 55 is shown, configured to divert a hydrocarbon and/or drilling mud stream flowing up through the riser; wherein the inner barrel 52 of the telescopic joint is secured to the diverter. According to the first aspect of the invention, the diverter 55 is connected stationary to the floating hull, here flush with the main deck 12. The upper inner barrel 52 is secured to the diverter 55 via a flex joint, not shown in this drawing.

The top section including the drawworks and topdrive 18 as already shown in FIGS. 2 and 3 has been removed in the drawing of FIG. 5. Also shown are the storage racks 110, 111 for tubulars, e.g. drill pipes and casing, here multi-jointed tubulars. Such racks are also referred to as carousels.

At the side of the mast 10 facing the firing line 16 the drilling system is provided with a pipe racker system, here comprising two tubular racking devices 140 and 140', each mounted at a corner of the mast 10. If no mast is present, e.g. with a latticed derrick, a support structure can be provided to arrive at a similar arrangement of the racking devices 140 and 140' relative to the firing line 16.

Figure 6:
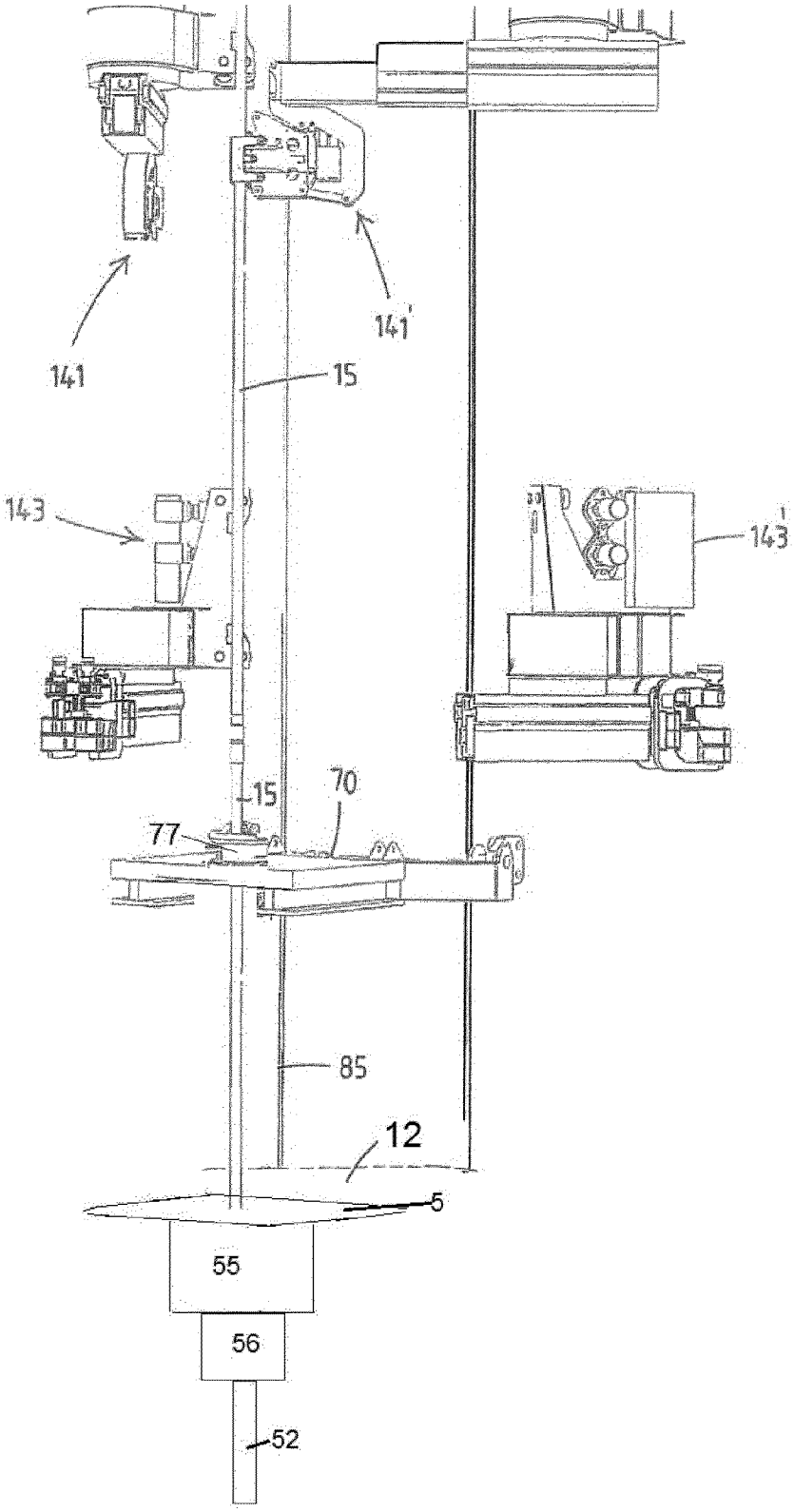
FIG. 6 illustrates the assembly of a new drill pipe to the drill string in heave motion.
Figure 7A:
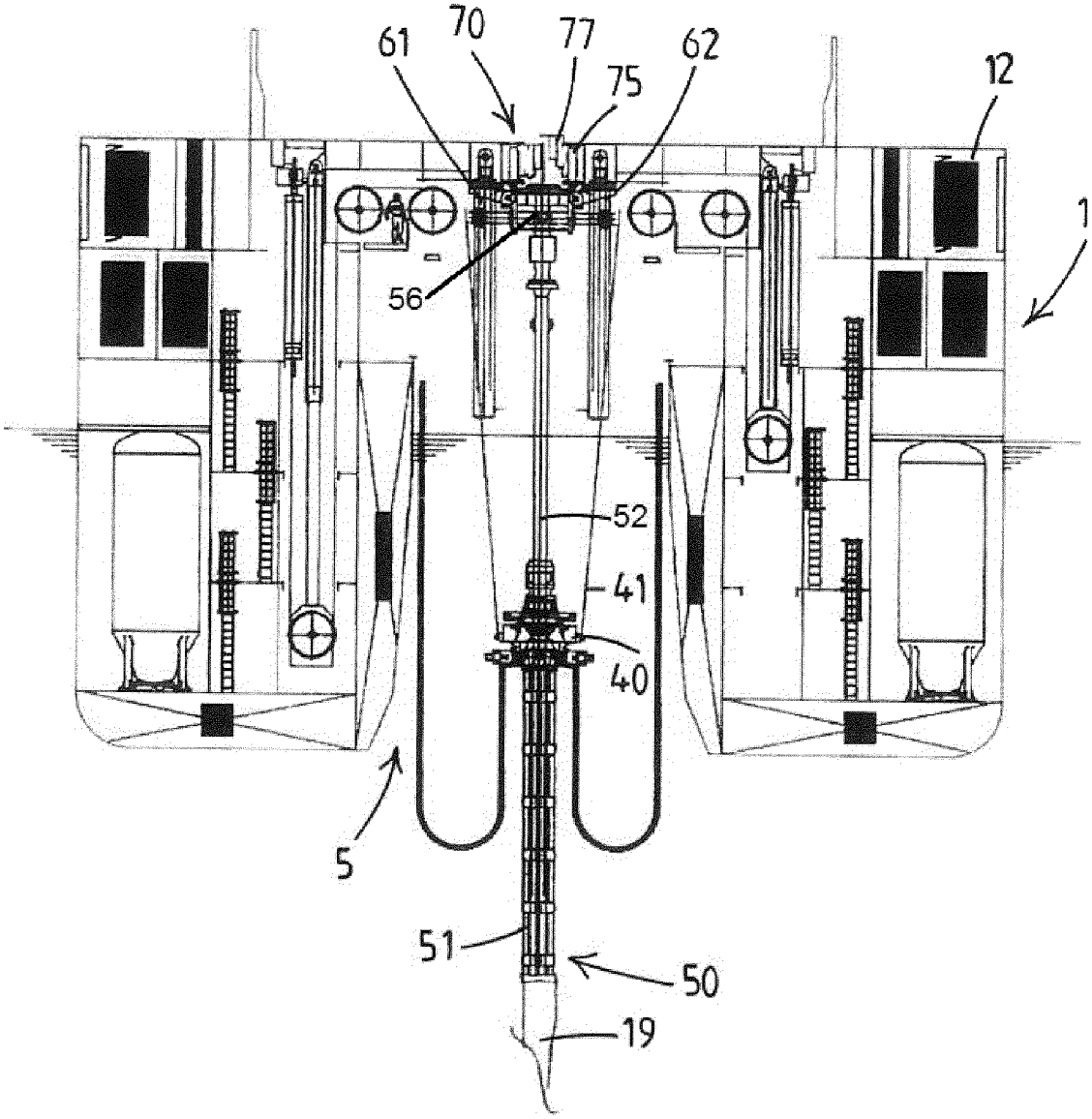
FIGS. 7*a* and 7*b* show in a cross sectional view a riser, a telescopic joint, a vessel including a riser tensioning system and a heave motion compensated working platform.
Figure 7B:
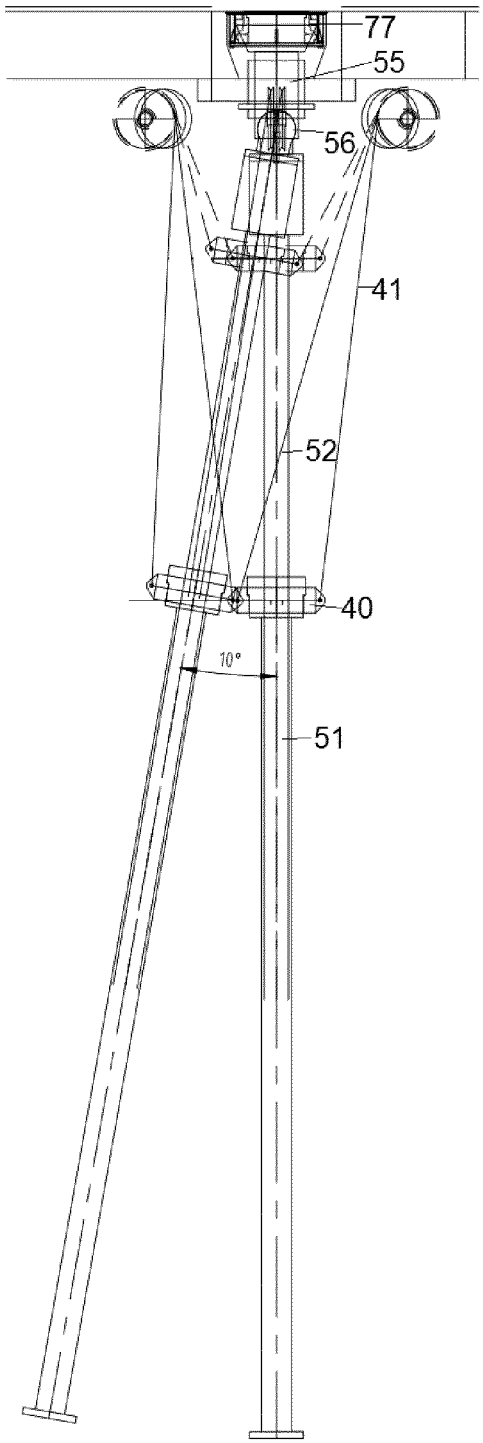

In the shown embodiment of FIG. 6, each racking device 140, 140' has multiple, here three racker assemblies. Here a lower first tubular racker assembly 141, 141', a second tubular racker assembly 142, 142', operable at a greater height than the first tubular racker assembly, and a third tubular racker assembly 143, 143'.

Each set of racker assemblies is arranged on a common vertical rails 145, 145' that is fixed to the mast 10, here each at a corner thereof.

In the embodiment of FIG. 6, a drill pipe multi-joint tubular may be held by racker assemblies 142' and 141' in the firing line above the well center 27, thereby allowing to connect the tubular to the riser. Each of said assemblies 142' and 141' carries a tubular gripper member 142'*t* and 141'*t* at the end of the motion arm of the assembly.

The lower racker assembly 143 of the other racker device 140 carries an iron roughneck device 150, optionally with a spinner thereon as well.

According to a preferred embodiment of the first aspect of the invention, the pipe racker system is provided with a heave motion synchronization system, adapted to bring a drill pipe retrieved from a drill pipe storage rack into a vertical motion synchronous with the heave motion of the upper end of the riser, e.g. of the working deck resting thereon, thereby allowing the interconnect the drill pipe to a drill pipe string suspended from a slip device. Hence, in the shown embodiment, the two tubular racking devices 140 and 140', each with three racker assemblies, are mobile in heave compensation mode.

It is both conceivable that the racker assemblies are mobile in heave compensation mode with respect to their common vertical rails 145, 145', and that the common vertical rails 145, 145' with the racker assemblies are mobile in heave compensation mode with respect to the mast 10.

In FIG. 6 the assembly of a new drill pipe 15, held by the pipe racker system of FIG. 5 comprising racker assemblies mounted on vertical rails, which pipe racker system is provided with a heave motion synchronization system that brings the drill pipe 15 retrieved from a drill pipe storage rack (not shown in FIG. 6) into a vertical motion synchronous with the heave motion of the upper end of the riser, thereby allowing the interconnect the drill pipe 15 to a drill pipe string suspended from a slip device. to the drill string in heave motion is shown in a detailed perspective view. In FIG. 6, racker assemblies 143 and 143' and 141 and 141' are visible, wherein racker assembly 141' grips the drill pipe 15.

Figure 8:
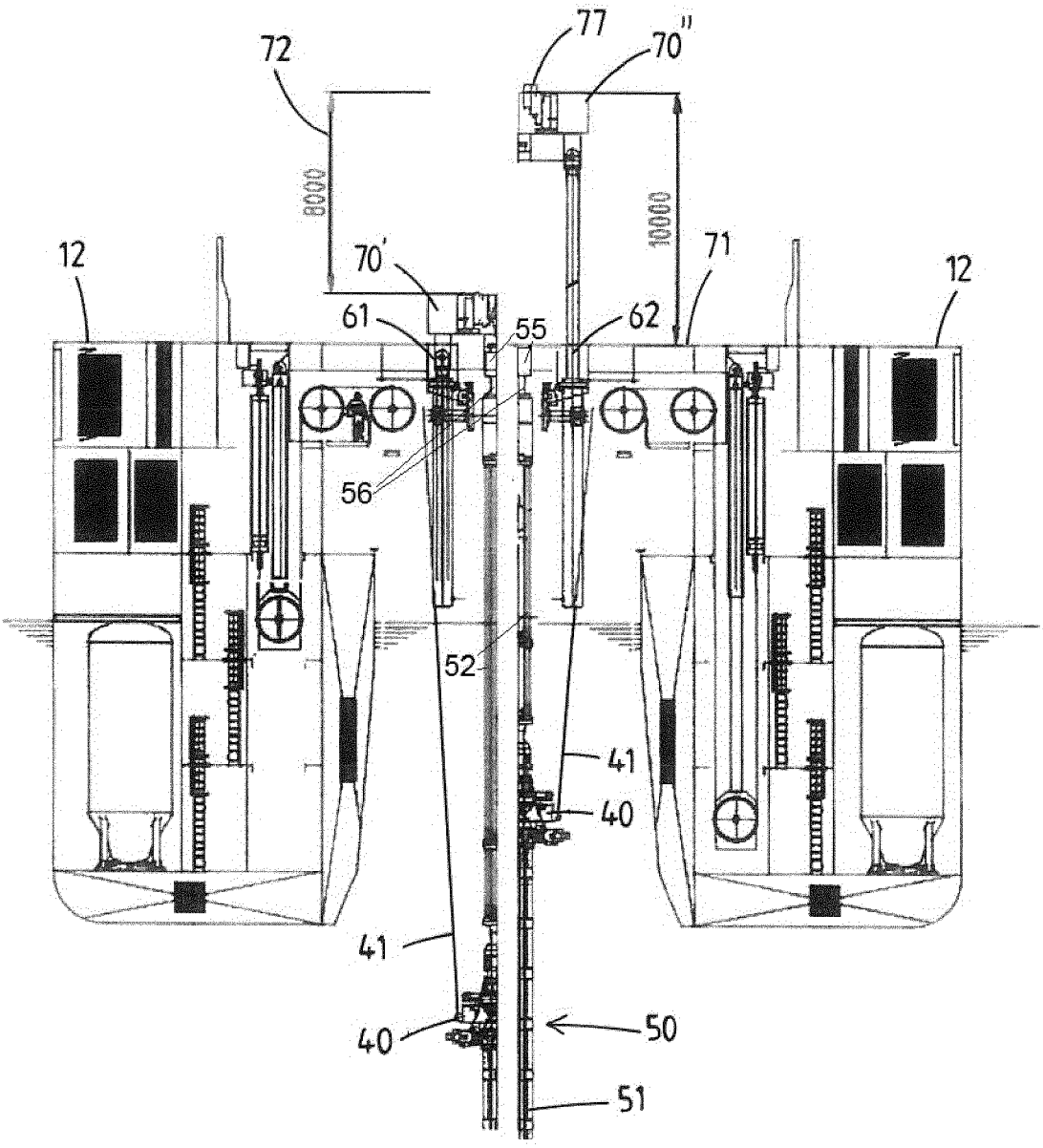
FIG. 8 shows in a left sided view a deck compensator of the heave motion system in a lower position and in a right sided view a deck compensator of the heave motion system in an upper position.
Figure 9:
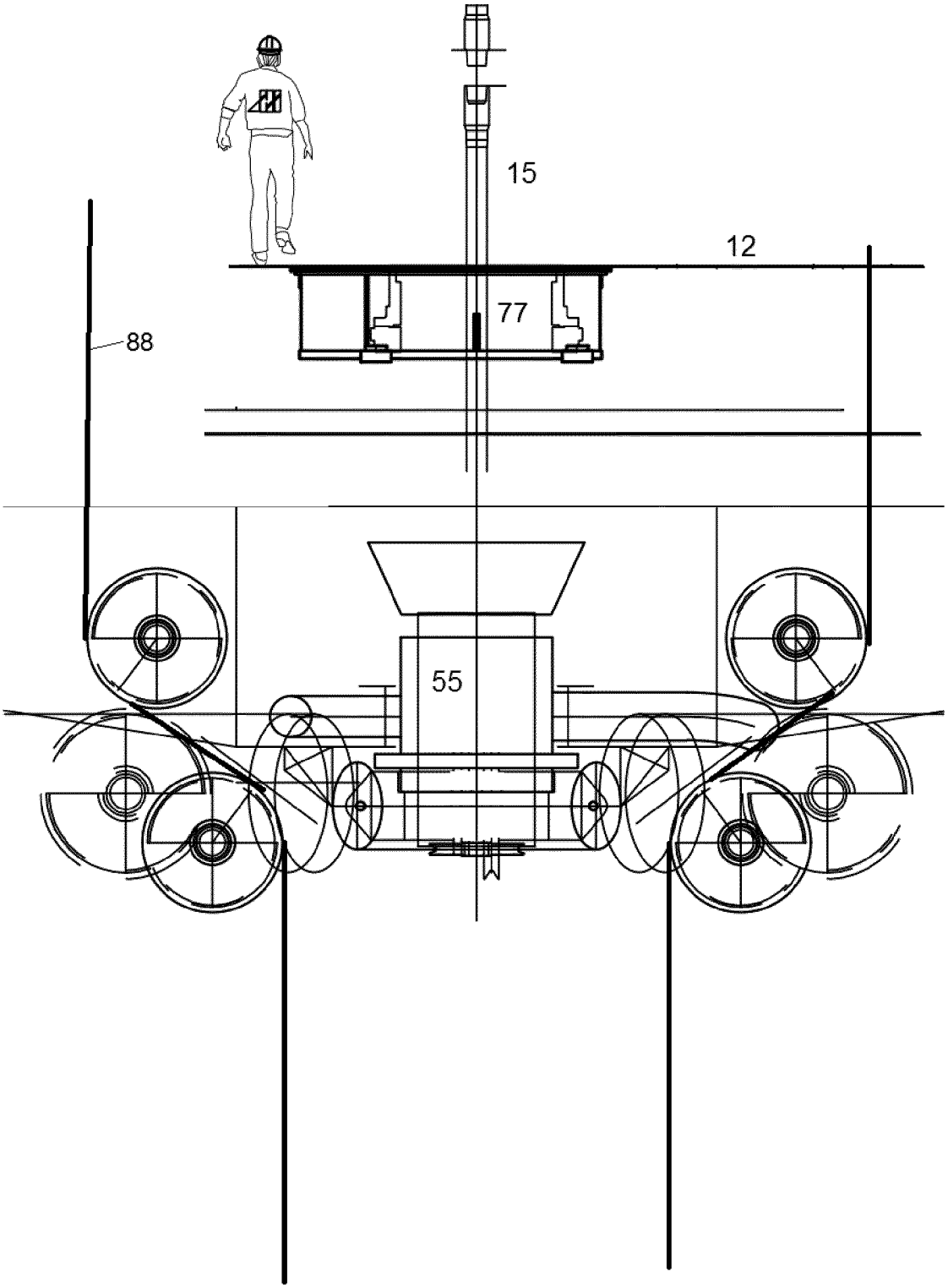
FIG. 9 shows schematically the configuration of the diverter connected stationary to the floating hull and mechanical connector.

FIG. 7*a*-10 further show the vessel 1 provided with a vertically mobile working deck 70 that is vertically mobile within a motion range including a lower stationary position, wherein the working deck is used as a drill floor deck stationary with respect to the hull of the vessel. The shown position of the working deck 70 in FIGS. 7*a* and 7*b*, FIG. 9 and the left-hand part of FIG. 8 is also called a regular position of the working deck in which the working deck 70 is aligned with main deck 12. The diverter 55 is connected stationary to the floating hull, and is provided right below the working deck 70, in particular below the rig floor slip device.

Figure 10A:
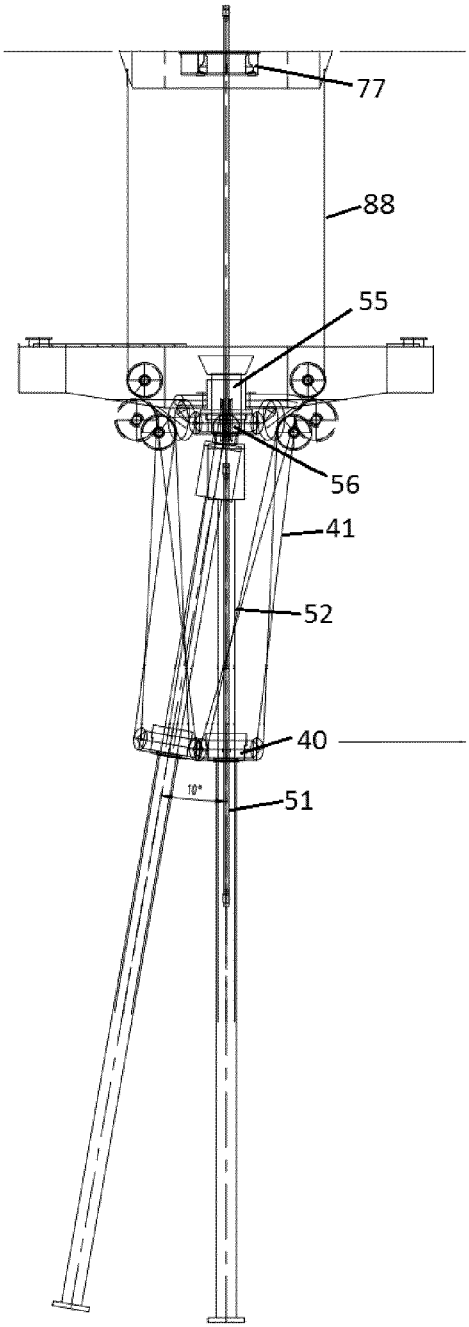
FIGS. 10 *a* and *b* show in a left sided view a deck compensator of the heave motion system in a lower position and in a right sided view a deck compensator of the heave motion system in an upper position.
Figure 10B:
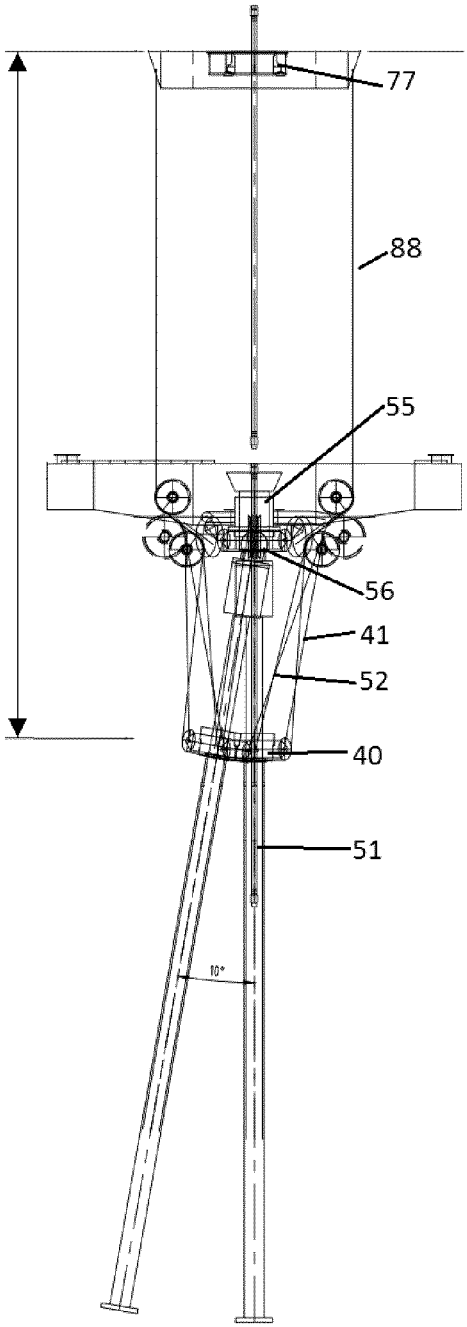

In the right-hand part of FIG. 8 and in FIG. 10, the working deck 70 is in a motion range including a heave compensation motion range that lies higher than the lower stationary position. In this heave compensation motion range the working deck 70 can perform heave compensation motion relative to the hull of the vessel. According to the first aspect of the invention, the diverter 55 with suspended therefrom the telescopic joint remains attached to the hull.

For example the heave compensation motion range is between 5 and 10 meters, e.g. 6 meters. For example the average height of the working deck in heave motion above the driller cabin deck with cabin of the vessel is about 10 meters.

The drawings show that the working deck 70 has an opening 75 therein that is aligned with the firing line 16, the opening 75 being dimensioned to at least allow for passage of the tubular string 15 that extends into and through the riser 19. The working deck is provided with a tubular string suspension device, e.g. a device known as a rig floor slip device 77 or slip tool in the drilling field.

The working deck 70 may be provided with a rotary table.

In the right-hand part of FIG. 8 and in FIG. 10, the diverter 55 with suspended therefrom the telescopic joint remains attached to the hull while the working deck 70 is in a heave motion range. In order to remain the vertical spacing between the working deck 70 and the outer barrel 51 constant, (in particular and the fixed length riser section 19, provided below the outer barrel 51), the mechanical connector 88 is provided to effectively replace the former direct connection between riser and working deck. The mechanical connector 88 in the shown embodiment is a cable extending between the riser tensioning ring 40 and the mobile working deck 70.

With reference to the drawings an example of an offshore drilling system for performing subsea wellbore related activities, e.g. drilling a subsea wellbore, according to the second aspect of the invention will now be discussed.

Figure 11:
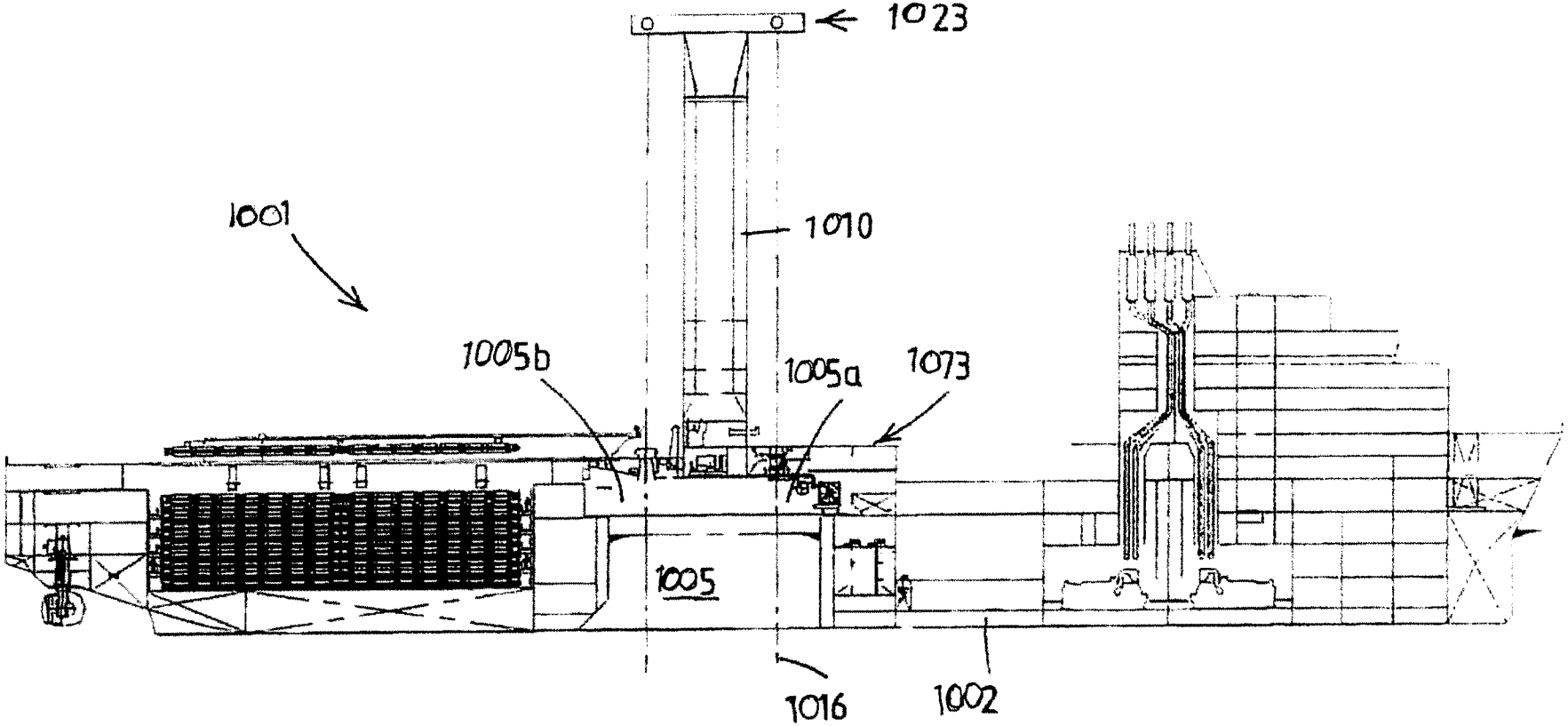
FIG. 11 shows schematically in vertical cross-section a drilling vessel of an offshore drilling system according to the second aspect of the invention.
Figure 12:
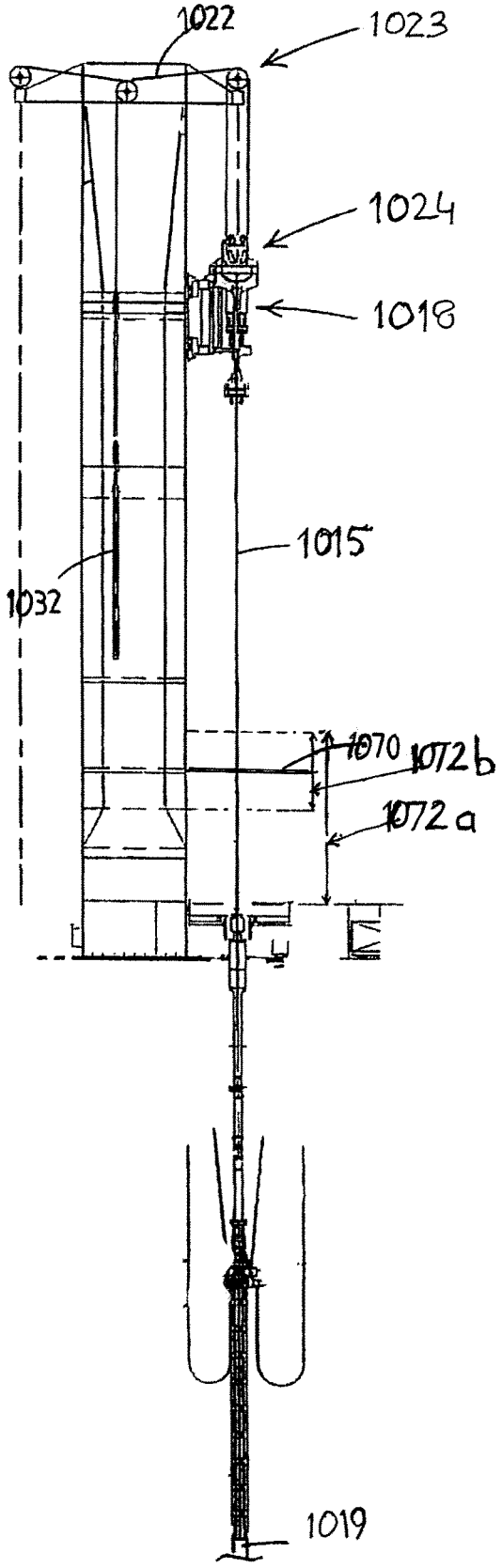
FIG. 12 shows a portion of the vessel with a drilling tower with a compensator cylinder therein and a mobile working deck.

As shown in FIG. 11 and FIG. 12, the system comprises a drilling vessel 1001 having a floating hull 1002 subjected to heave motion, the hull comprising a moonpool 1005, here the moonpool having a fore portion 1005*a* and an aft portion 1005*b*.

As is preferred the vessel 1001 is a mono-hull vessel with the moonpool extending through the design waterline of the vessel. In another embodiment, for example, the vessel is a semi-submersible vessel having submergible pontoons (possibly an annular pontoon) with columns thereon that support an above-waterline deck box structure. The moonpool may then be arranged in the deck box structure.

The vessel is equipped with a drilling tower 1010 at or near the moonpool. In this example, as is preferred, the tower is a mast having a closed outer wall and having a top and a base. The base of the mast is secured to the hull 1002. In this example the mast is mounted above the moonpool 1005 with the base spanning the moonpool in transverse direction.

In another embodiment the tower 1010 can be embodied as a derrick, e.g. with a latticed derrick frame standing over the moonpool.

The vessel 1001 is provided with a tubular string main hoisting device, the tubular string for example being a drill string 1015.

Figure 13:
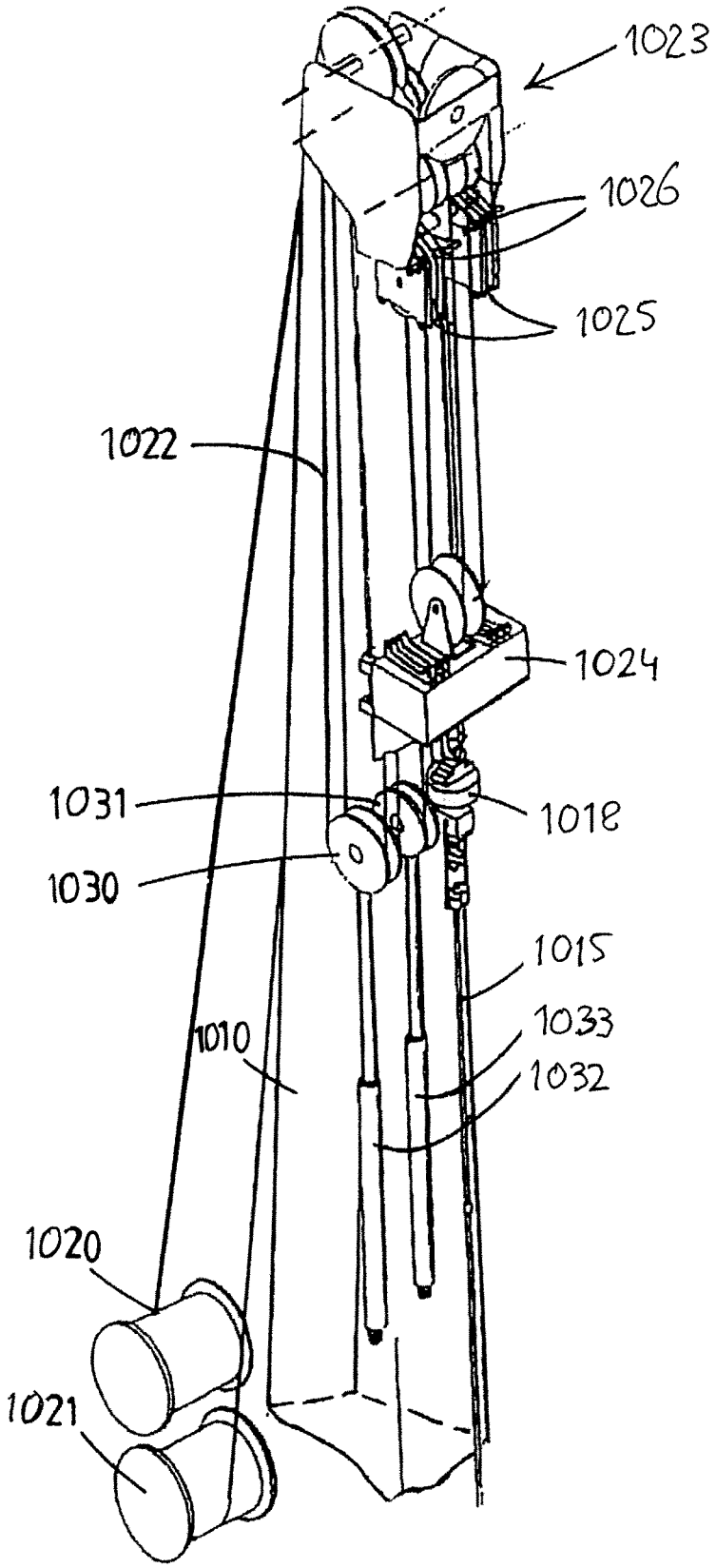
FIG. 13 shows in a perspective view a main hoisting device provided with a heave compensation system including two sheave compensators.
Figure 14:
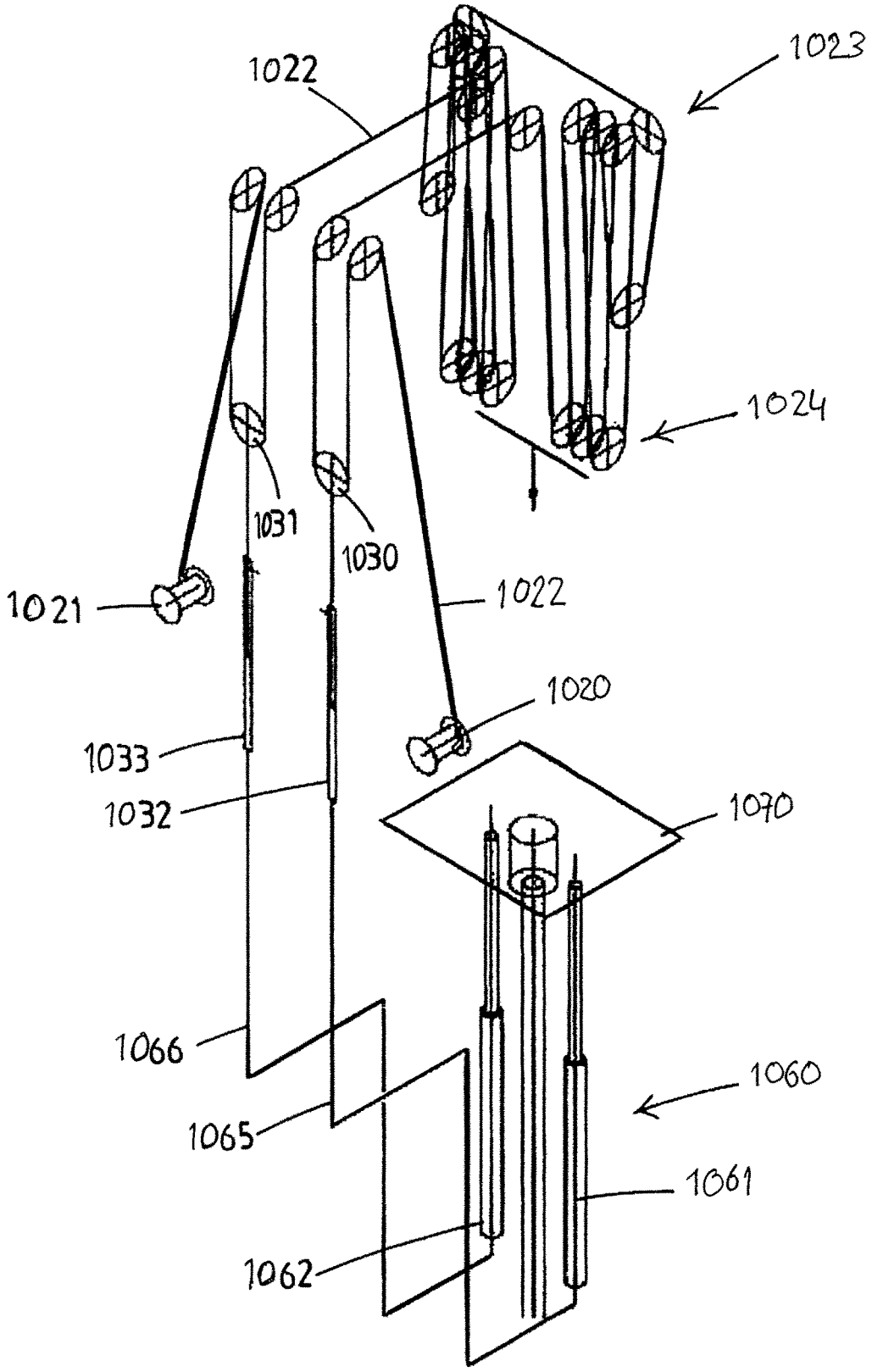
FIG. 14 shows in a perspective view the heave motion system of FIG. 13, wherein heave compensation cylinders are hydraulically connected to a mobile working deck support cylinder.

The main hoisting device is further illustrated in FIG. 13 and FIG. 14.

Figure 18:
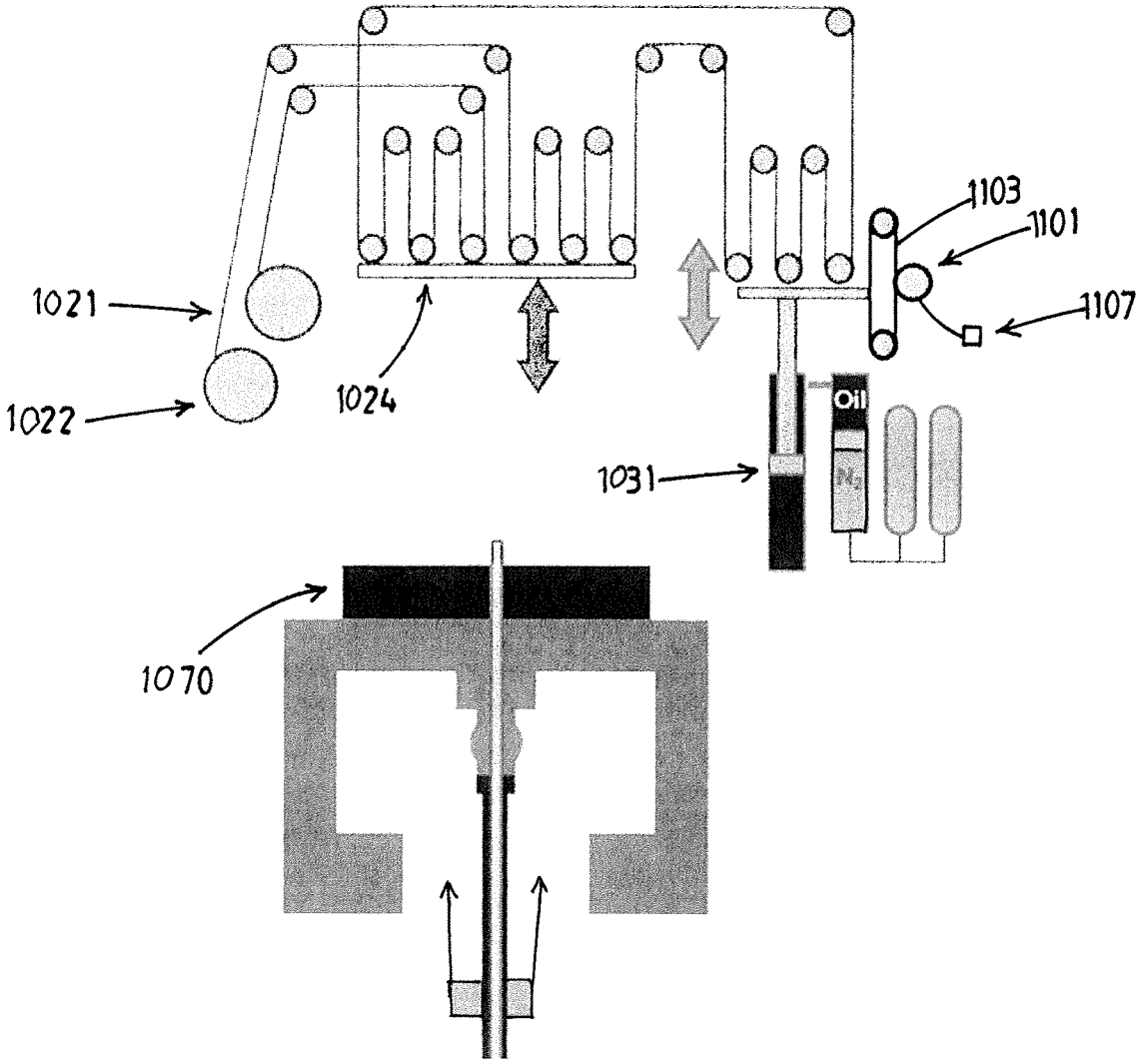
FIG. 18 shows the offshore drilling system of FIG. 16 in a second working condition.

The main hoisting device comprises:

a main hoisting winch, here first and second winches 1020, 1021, and a main cable 1022 that is connected to said winches 1020, 1021, a crown block 1023, here at the top end of the mast 1010, and a travelling block 1024 that is suspended from the crown block 1023 in a multiple fall arrangement of the main cable 1022. In FIG. 18, the travelling block 1024 is suspended in a 12-fall arrangement from the crown block 1023.

In the exemplary embodiment shown in FIG. 13 one or more main cable sheaves connected to the travelling block 1024 have an individual lower latching device 1025 allowing to connect and disconnect the individual sheave to and from the travelling block 1024. Preferably these one or more sheaves also have an upper latching device 1026 allowing to latch the sheave to the crown block if the sheave is disconnected from the travelling block. This "splittable block" arrangement is known in the art.

The travelling block 1024 is adapted to suspend a tubular string, e.g. the drill string 1015, therefrom along a firing line 1016, here shown (as preferred) with an intermediate top-drive 1018 that is supported by the travelling block 1024 and that is adapted to provide a rotary drive for the drill string.

Figure 15:
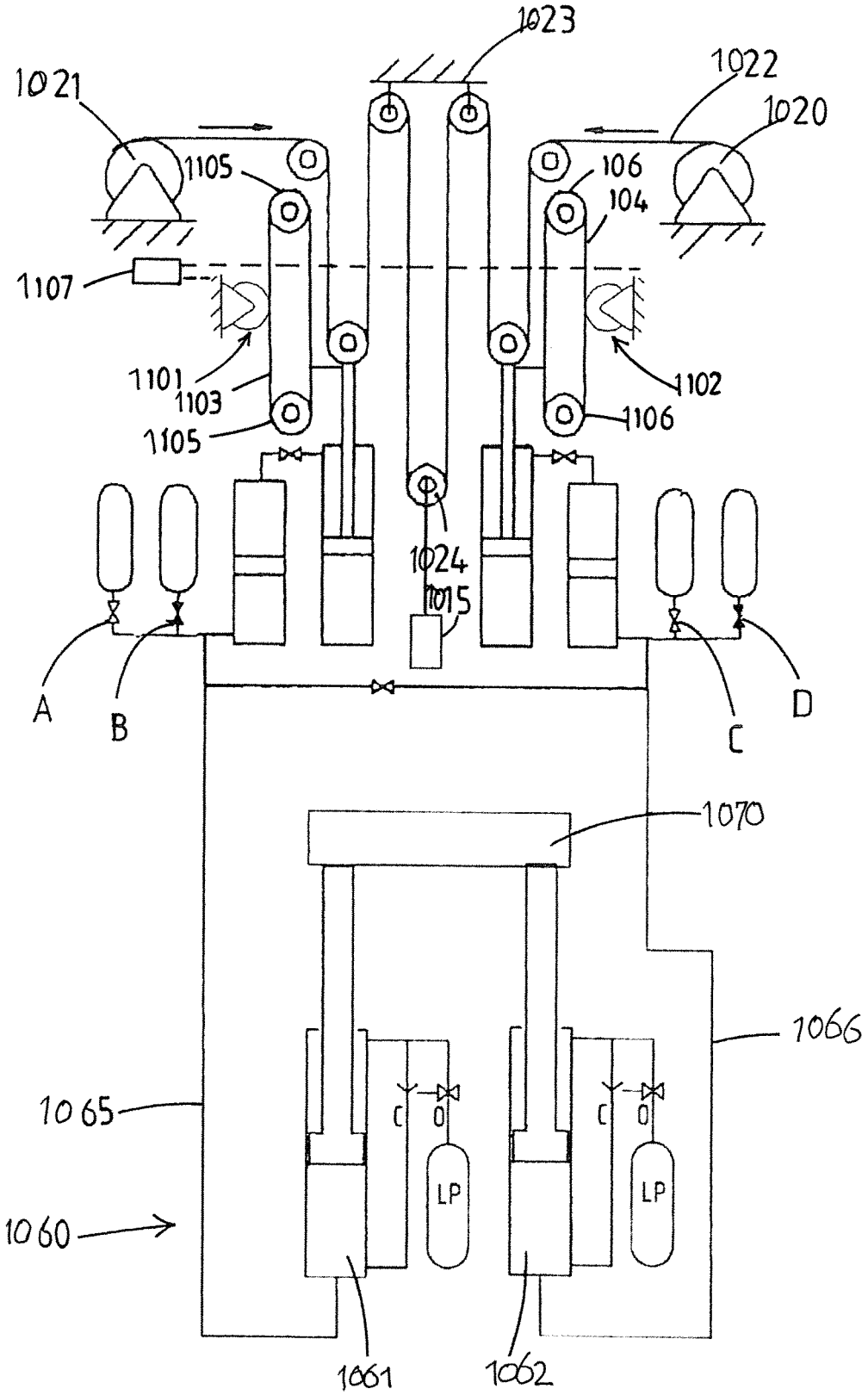
FIG. 15 shows the heave motion system of FIG. 14 with a mobile deck dynamic positioning system according to the second aspect of the invention.

FIG. 15 shows in a schematic view, the main hoisting device which comprises a first main hoisting winch 1020 and the second main hoisting winch 1021, wherein the main cable 1022 is connected at either end thereof to a respective one of the first and second main hoisting winches 1020, 1021.

The vessel 1001 is provided with a heave compensation system adapted to provide heave compensation of the travelling block 1024. This heave compensation system comprises a main cable heave compensation sheave head, here two sheave heads 1030,1031, one each in the path between each of the main hoisting winches 1020, 1021 and the travelling block 1024. These sheave heads 1030, 1031 are each connected to a passive and/or active heave motion compensator device, here including hydraulic heave cylinders, also called heave compensation cylinders 1032, 1033, which are each connected to a respective sheave head 1030, 1031.

In the shown embodiment each heave compensation cylinder comprises a piston rod, the main cable heave compensation sheave head 1030, 1031 being connected to said piston rod. For example the heave compensation cylinders 1032, 1033 each have a stroke between 5 and 15 meters, e.g. of 6 meters. As is preferred, the cylinders 1032, 1033 are mounted within the mast in vertical orientation. FIG. 13 shows the lengthy cylinders 1032, 1033 including a fully extended position of the piston rods thereof which are preferably mounted vertically within the mast 1010.

As further shown in FIG. 15, as an example of a passive heave compensation system, each heave compensation cylinder 1032, 1033 is connected to a hydraulic/gas separator cylinder A, B, C, D, one chamber thereof being connected to a gas buffer as is known in the art.

As shown in FIG. 14, the heave compensation system is arranged to provide heave compensation of the travelling block 1024 of the main hoisting device, but also to provide heave compensation of a mobile working deck 1070. The mobile working deck 1070 is positioned above the moonpool 1005. The working deck 1070 comprises equipment, like a slip tool 1077, to carry out operational steps to a tubular string, in particular a drill string 1015.

The mobile working deck 1070 is supported by two hydraulic support cylinders 1061, 1062 which are positioned below the mobile working deck mobile working deck support cylinders. The deck support cylinders are each connected to the vessel 1001 and the mobile working deck 1070. The deck support cylinders comprises at least one double acting hydraulic cylinder. The hydraulic support cylinders 1061, 1062 are positioned opposite each other. The hydraulic support cylinders 1061, 1062 are positioned at opposite sides of the firing line 16. Here, the firing line 1016 and the two hydraulic support cylinders 1061, 1062 are positioned in a common plane which is oriented in a vertical direction. Advantageously, the arrangement of the deck support cylinders 1061, 1062 contribute to the accessibility of the area below the working deck 1070.

As shown in FIG. 14, the heave compensation cylinders 1032, 1033 and the deck support cylinders 1061,1062 are hydraulically interconnected by a hydraulic conduit 1065, 1066. The first hydraulic heave compensation cylinder 1032 is hydraulically connected via the first hydraulic conduit 1065 to the first hydraulic mobile deck support cylinder 1061 and the second heave compensation cylinder 1033 is hydraulically connected via the hydraulic conduit 1066 to the second hydraulic mobile deck support cylinder 1062. Advantageously, the hydraulic interconnection of the heave compensation cylinders and the deck support cylinders provides a synchronous compensated heave motion of both the travelling block 1024 and the working deck 1070.

The mobile working deck 1070 is movable with respect to the vessel 1001, in particular the drilling tower 1010, along the firing line 1016 within a motion range 1072*a* including a heave compensation motion range 1072*b*. The motion range is further illustrated and explained hereafter.

FIG. 15 shows an example of an offshore drilling system for performing subsea wellbore related activities involving a riser 1019 extending between the vessel and a subsea wellbore, more in particular shows a mobile working deck dynamic positioning system according to the second aspect of the invention.

The offshore drilling system comprises the floating hull 1001, the moonpool 1005, the drilling tower 1010 positioned on said hull at or near the moonpool 1005, the tubular string main hoisting device, and the vertically mobile working deck 1070.

The tubular string main hoisting device comprises a main hoisting winch, in the particular embodiment shown two hoisting winches 1020, 1021, and a main cable 1022 driven by the main hoisting winches, a crown block 1023, and a travelling block 1024.

The travelling block 1024 is suspended from the crown block 1023 via the main cable 1022, and is adapted to suspend a tubulars string 1015 along the firing line 1016. The firing line 1016 extends through the moonpool 1005.

The vertically mobile working deck 1070 is positioned above the moonpool 1005, and is vertically movable with respect to the drilling tower 1010 along the firing line 1016 within a motion range including a heave compensation motion range 1072.

The mobile working deck 1070 is supported by a support cylinder, in the embodiment shown by two deck support cylinders 1060. The deck support cylinders 1061, 1062 are each connected to the vessel and to the mobile working deck 1070 to vertically move the working deck 1070 relative to the vessel 1001, within the motion range including the heave compensation motion range 1072.

In the embodiment shown, the support cylinders 1060 are located below the mobile working deck. It is submitted that in an alternative embodiment the mobile deck support cylinder, or support cylinders, may be located above the mobile working deck, supporting the mobile working deck form above.

The heave compensation system is configured to provide heave compensation of the travelling block 1024 as well as of the mobile working deck 1070. The heave motion compensation system comprises a heave compensation cylinder, in the embodiment shown two heave compensation cylinders 1032, 1033. The heave compensation cylinders 1032, 1033 are connected to a gas buffer for providing the tubular string main hoisting device with passive heave compensation.

Sheave heads 1030, 1031, comprising one or more sheaves for engaging the main cable 1022 of the main hoisting device, are supported by a piston of the respective heave compensation cylinder 1032, 1033 for movement along a heave compensation trajectory.

The mobile working deck support cylinders 1060 are hydraulically connected with the heave compensation cylinders 1032, 1033 of the heave compensation system, such that in operation the mobile working deck support cylinders 1060 move synchronously with the heave compensation cylinders 1032, 1033 of the heave compensation system. Thus the mobile working deck 1070 moves synchronously with the travelling block 1024.

The mobile working deck 1070 is movable with respect to the vessel 1001, in particular the drilling tower 1010, along the firing line 1016 within a motion range including a heave compensation motion range 1072. The motion range includes a heave compensation motion range 1072 that lies higher than the lower stationary position 1071 of the mobile working deck 1070. In this heave compensation motion range the mobile working deck 1070 can perform heave compensation motion relative to the hull of the vessel.

For example the heave compensation motion range is between 5 and 10 meters, e.g. 6 meters. For example the average height of the working deck in heave motion above the driller cabin deck 1073 with cabin 1074 of the vessel is about 10 meters.

According to the second aspect of the invention, the offshore drilling system comprises a mobile working deck dynamic positioning system for moving the mobile working 1070 deck along the firing line 1016 within the motion range including the heave compensation motion range 1072.

The mobile working deck positioning system comprises a positioning winch 1101, 1102 with an associated positioning cable 1103, 1104, a control device 1107 and one or more sheaves 11105, 1106.

In the particular embodiment shown, the heave compensation system is provided with two heave compensation cylinders 1032, 1033, and each heave compensation cylinder is connected with a positioning winch 1101, 1102. The positioning winches 1101, 1102 are each provided with an associated positioning cable 1103, 1104.

In the embodiment shown, the mobile working deck positioning system further comprises two sheaves 1105, 1106, the sheaves guiding the positioning cable in a loop along the heave compensation trajectory. In the particular embodiment shown, the cables are each guided over two sheaves, and thus form a loop that extends along the heave compensation trajectory of the related heave compensation cylinder. On one side the looped positioning cable is connected with the winch, and on the other side to the heave compensated cylinder.

The control device 1107 is adapted to control the speed of the positioning winches 1101, 1102.

The positioning cables 1103, 1104 are connected to the piston of the heave compensation cylinders 1032, 1033, and can in addition or as an alternative be connected to the sheave heads of the heave compensation cylinders, such that the positioning winches 1101, 1102 can pull the piston of the heave compensation cylinders 1032, 1033 in opposite directions along the heave compensation trajectory and, and thus position the mobile working deck 1070 with, i.e. using, the mobile working deck support cylinders 1060 that are hydraulically connected to the heave compensation cylinders 1032, 1033.

In an embodiment, a trolley is provided, which trolley is coupled to the piston of the heave compensation cylinder, preferably to the sheave head supported by the piston of the heave compensation cylinder, via a connector device and is coupled to the adjusting winch via the adjusting wire. Such a trolley is thus connected to the positioning cable, and pulls the piston rod of the heave compensation cylinder.

In an embodiment, a trolley, i.e. a rail bound vehicle, is supported on a track adjacent the heave compensation trajectory of the sheave head of the heave compensation cylinder. In such an embodiment, the trolley track moveably supports the trolley, such that the trolley can move along the heave compensation trajectory while movement in a direction perpendicular to the trolley track is prevented. Thus, the main purpose of the trolley track is to keep the trolley adjacent the sheave head, preferably at a constant relative position, while the sheave head and trolley travel along the heave compensation trajectory.

In heave compensation systems, a cylinder is typically connected to the hoisting wire, i.e. to the reeving of a drilling drawworks, using a sheave head. Employing a trolley on a track adjacent the heave compensation trajectory of the sheave head, and thus the outer end of the piston, for pulling the piston of the cylinder along the heave compensation trajectory, allows for integrating the adjusting system with prior art heave compensation systems.

It is submitted that the configuration known from heave compensation adjusting systems known form the prior art, in particular from WO2016/062812 can be used.

In the particular embodiment shown, the heave compensation system is provided with two heave compensation cylinders, and each heave compensation cylinder is connected with a positioning winch. In an alternative embodiment, for example two compensation cylinders are connected to a single positioning winch. In another embodiment, the heave compensation system comprises a single heave compensation cylinder, which is connected to a single compensation winch. In yet another embodiment, the heave compensation system comprises a single heave compensation cylinder, which is connected to two compensation winches. Many configurations are possible to combine the heave compensation system with the mobile working deck positioning system.

In a preferred embodiment, the mobile working deck positioning system comprises a motion reference unit, or MRU, to provide the mobile working deck positioning system with information, for example information relating to the heave of the vessel.

Figure 16:
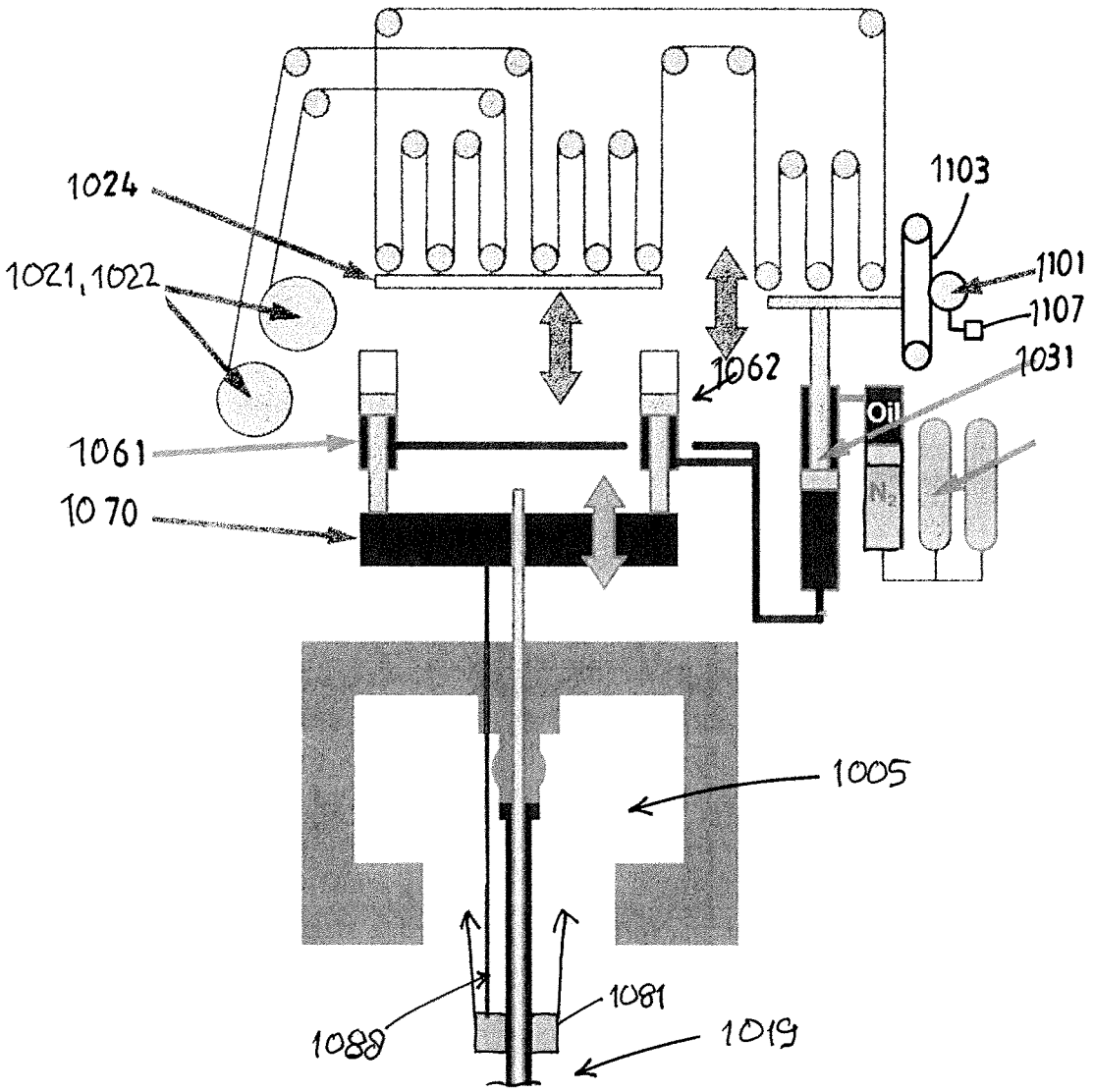
FIG. 16 shows another exemplary embodiment of an offshore drilling system according to the second aspect of the invention.

FIG. 16 shows another exemplary embodiment of an offshore drilling system according to the second aspect of the invention. The figure schematically depicts the draw works, i.e. main hoisting winches 1020, 1021, crown block 1023 and 1024. The figure further schematically depicts the heave compensation system, the mobile working deck 1070, the moonpool 1005 of the vessel and the mobile working deck positioning system. In contrast with the embodiment shown in FIG. 14, the drawworks are provided with a single heave compensation cylinder 1032.

The main hoisting device of the drilling tower is fitted with the heave compensation cylinder 1032, indicated as the Passive Heave Compensating (PHC) cylinder. The cylinder is pressurized, via a medium separator, by a volume of pressurized nitrogen. The PHC is coupled with the mobile working deck dynamic positioning system, which can force the PHC cylinder rod/head/sheave actively up and down.

The mobile working deck is supported by hydraulic mobile working deck support cylinders 1061, 1062, which in this embodiment are located above the mobile working deck and thus function as pull cylinders.

The bottom of the heave compensation cylinder 1032 and the mobile working deck support cylinders 1061, 1062 are coupled by a hydraulic line. With this hydraulic coupling, both the load of the travelling block 1024 and the load of the mobile working deck are supported by same pressurized nitrogen system. When a load is transferred from the travelling block to the mobile working deck, or vice versa, the total load supported by the nitrogen is not changed. No valves have to be opened or closed. It is a pure passive system.

The hydraulic connection between travelling block, more in particular the heave compensation cylinder, and mobile working deck, more in particular the mobile working deck support cylinder, automatically synchronizes the motion of the travelling block and the motion of the mobile working deck. The mobile working deck and travelling block can be kept stationary above the seabed by means of a mechanical connection with the riser, e.g. a wire 1088 connected to the riser tensioner ring (RT ring) 1081, for passive heave compensation. As an alternative, using active heave compensation, the positioning winch of the positioning system can be used to control the heave compensation cylinder.

Figure 17:
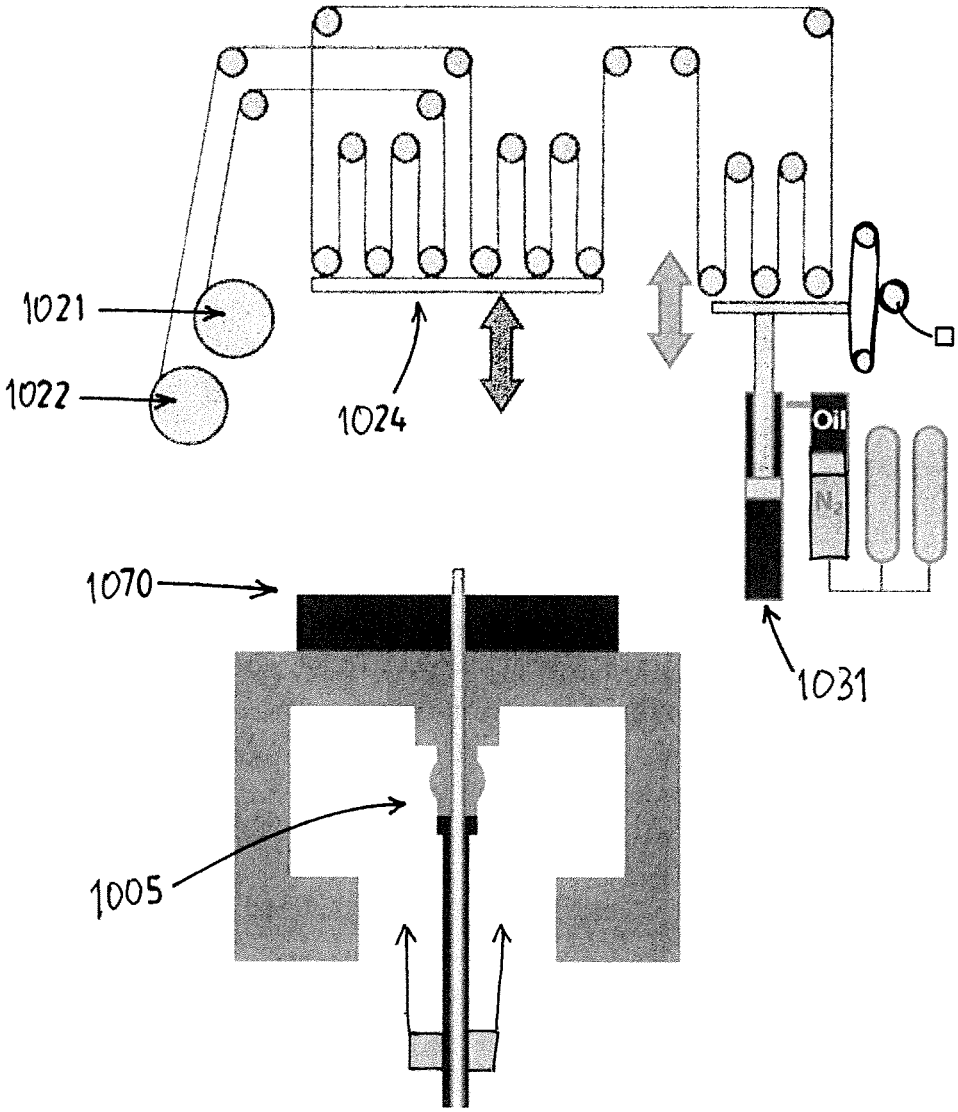
FIG. 17 shows the offshore drilling system of FIG. 16 in a first working condition.
Figure 19:
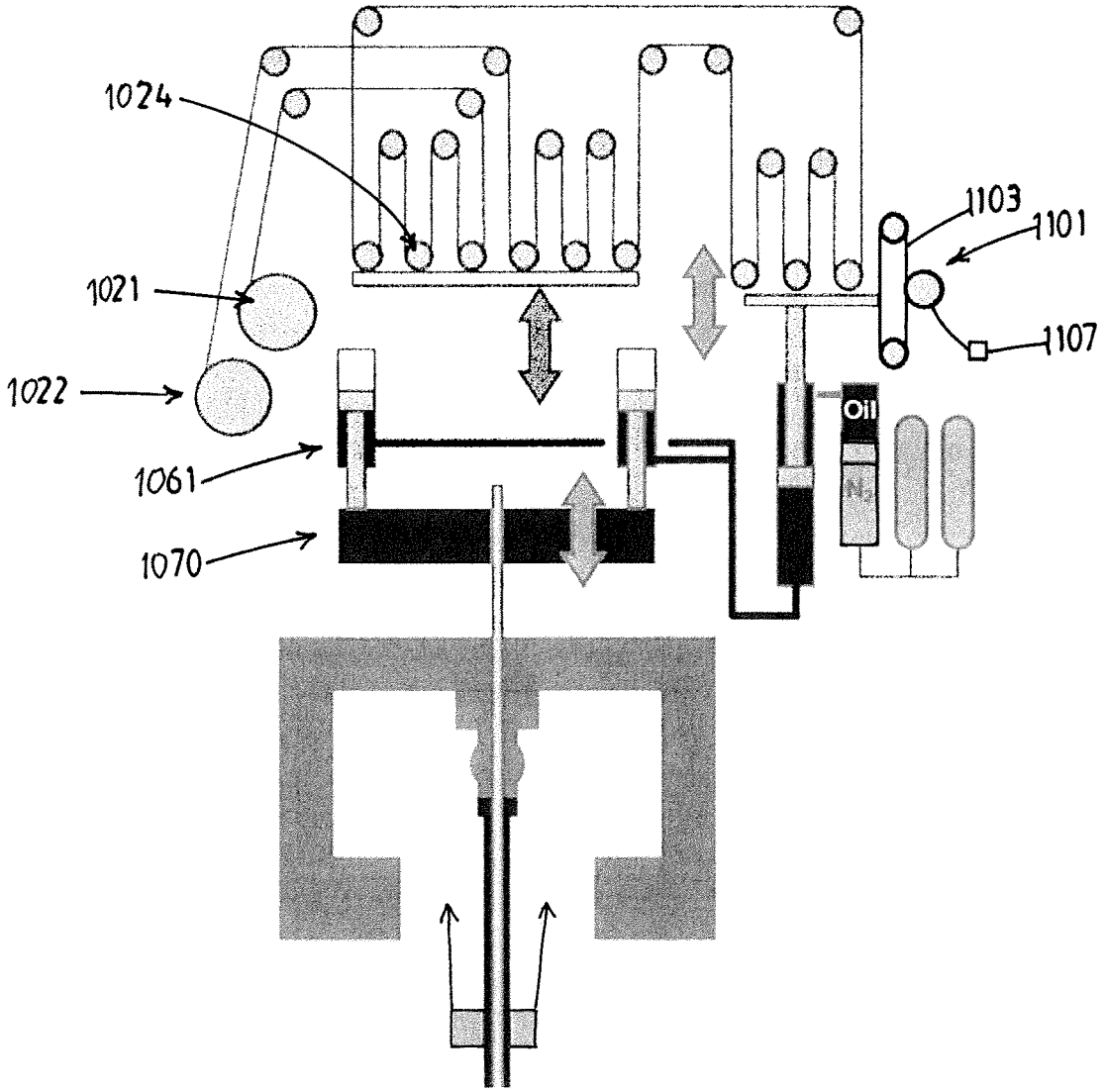
FIG. 19 shows the offshore drilling system of FIG. 16 in a third working condition.
Figure 20:
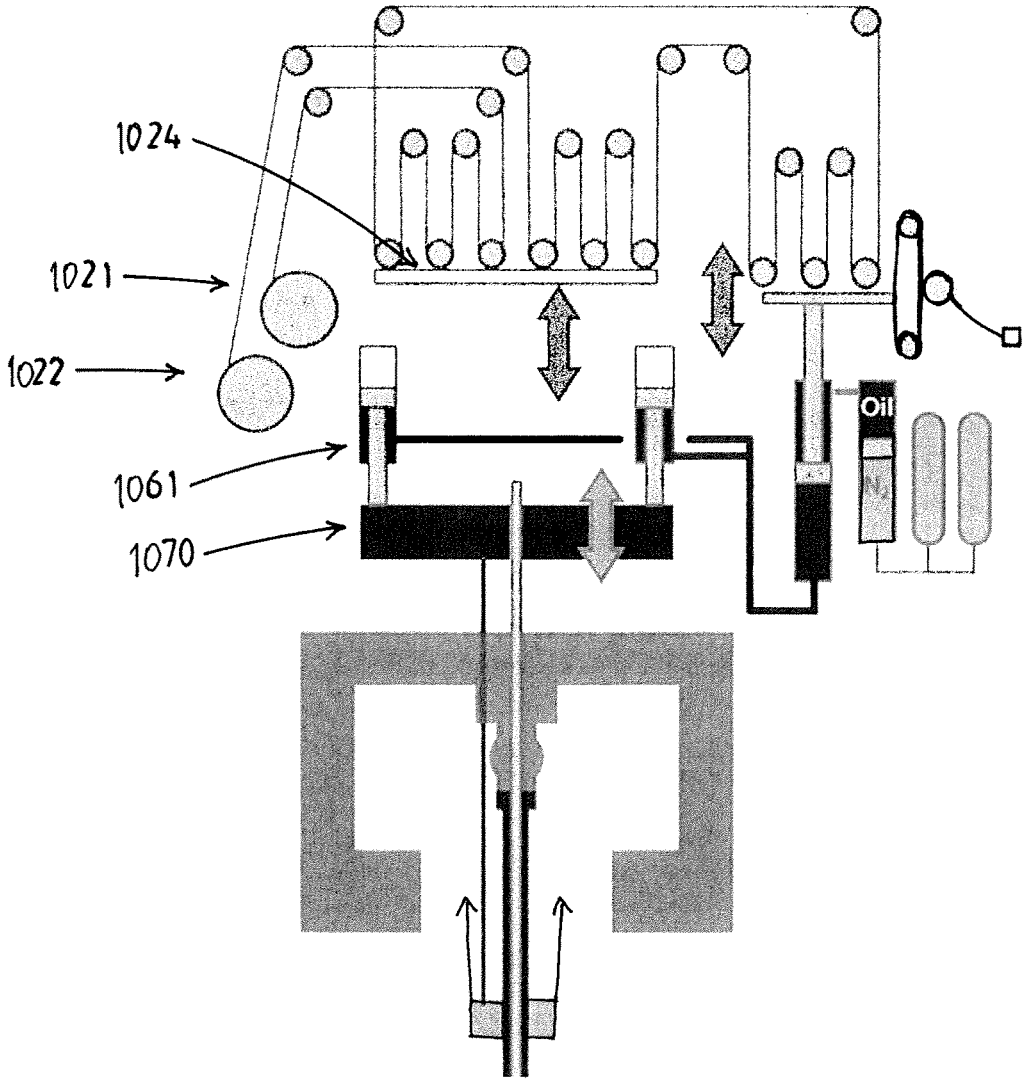
FIG. 20 shows the offshore drilling system of FIG. 16 in a fourth working condition.

Depending on the operation, the depicted system can be operated in the following conditions:

1. mobile working deck 1070 not heave compensated, and flush with the base structure, e.g. the deck of the vessel, wherein the travelling block 1024 is provided with passive heave compensation by the heave compensation cylinder 1032 only, shown in FIG. 17;
2. mobile working deck 1070 not heave compensated, and flush with base structure, wherein the travelling block 1024 is provided with active heave compensation, using the mobile working deck positioning system, shown in FIG. 18;
3. mobile working deck 1070 and travelling block 1024 are hydraulically coupled and provided with active heave compensation provided by the mobile working deck positioning system, wherein the control device 1107 is provided with heave information by a motion reference unit, shown in FIG. 19;
4. mobile working deck 1070 and travelling block 1024 are hydraulically coupled and are provided with active heave compensation by the mobile working deck positioning system, wherein the control device 1107 is provided with heave information by a cable connected to the riser tensioner ring (RT ring) of the riser, shown in FIG. 20;

FIG. 17 shows the offshore drilling system of FIG. 16 in the first working condition.

In this mode the mobile working deck is flush with the base structure and not heave compensated. No heave compensated connections can be made.

The traveling block is passive compensated, i.e. supported by the nitrogen pressurized heave compensation cylinder 1032 acting as a spring. When the load in the travelling block 1024 increases (caused by friction and/or accelerations) the cylinder moves, i.e. retracts or extends. The stiffness and nominal force can be adjusted by the volume and pressure of the nitrogen. The positioning winch 1101 is idling with the heave compensation cylinder head.

When transferring the load to the mobile working deck, the heave compensation cylinder has to blocked by closing valves.

FIG. 18 shows the offshore drilling system of FIG. 16 in a second working condition.

In this mode the mobile working deck 1070 is flush with the base structure and not heave compensated. No heave compensated connections can made.

The traveling block 1024 is actively compensated. The load is supported by a nitrogen pressurized heave compensation cylinder 1032 acting as a spring. A Motion Reference Unit measures the heave of the vessel and controls the positioning winch 1101 such that the heave compensation cylinder head is moved such that the travelling block 1024 remains at a constant elevation above the seabed.

The nitrogen pressurized heave compensation cylinder 1032 carries 80-90% of the load and the positioning winch 1101 the remaining 10-20%. Therefore the positioning winch 1101 consumes only a fraction of the power of actively heave compensated drawworks (which carry the full load).

When transferring a load to the mobile working deck, the heave compensation cylinder 1032 has to be blocked by closing valves.

The positioning winch can create instantly an additional pull up or down on the heave compensation cylinder head. With this, an additional pull or set down force of the travelling block can be created instantly.

FIG. 19 shows the offshore drilling system of FIG. 16 in a third working condition.

The traveling block and mobile working deck are actively compensated. The load is supported by a nitrogen pressurized heave compensation cylinder acting as a spring. A Motion Reference Unit (MRU) measures the heave of the vessel and controls the Positioning winch such that the heave compensation cylinder head is moved such that the travelling block and mobile working deck remain at a constant position above the seabed.

The nitrogen pressurized heave compensation cylinder preferably carries about 80-90% of the load and the positioning winch the remaining 10-20%. Therefore the positioning winch consumes only a fraction of the power of actively heave compensated drawworks (which carry the full load).

Both the load of the travelling block and the load of the mobile working deck are supported by same pressurized nitrogen system. When a load is transferred from the travelling block to the mobile working deck, or vice versa, the total load supported by the nitrogen is not changed.

The positioning winch can create instantly an additional pull up or down on the heave compensation cylinder head. With this, an additional pull or set down force of the travelling block can be created instantly.

To make sure that the additional pull (or set down force) is led to the pipe string (and not in to the riser), the mobile working deck and RT ring are not connected by the steel cable, or similar mechanical connection, or the cable has to be slacked off.

Preferably, the system is used to drill, trip drill pipe and trip casing in a positioning winch mode, i.e. without the steel wire, or similar mechanical connection, connected to RT ring, to be able to pull pipe free instantly and set weight on hangers etc.

FIG. 20 shows the offshore drilling system of FIG. 16 in a fourth working condition.

The traveling block and heave compensate floor (HCF) are passively compensated. The load is supported by a nitrogen pressurized heave compensation cylinder acting as a spring. A steel cable connecting the mobile working deck to the riser tensioner ring (RT ring) (and therefore with the seabed) holds the travelling block and mobile working deck at a constant elevation above the seabed.

The nitrogen pressurized PHC cylinder 1032 preferably carries about 110% of the load. The steel wire prevents the HCF and travelling block from moving upwards. Over speed detection on the cylinders will close valves preventing the floor to shoot upwards in case of steel wire failure.

Both the load of the travelling block and the load of the mobile working deck are supported by same pressurized nitrogen system. When the load is transferred from the travelling block to the mobile working deck, or vice versa, the total load supported by the nitrogen is not changed. No valves have to be opened or closed.

The positioning winch 1101 potentially can instantly create an additional pull up or down on the cylinder head of the heave compensation cylinder 1032. With this, an additional pull or set down force of the travelling block can be created instantly. However one cannot say whether this additional force is lead to the pipe string and/or to the riser. This is depended on the total stiffness of the wire/riser (water depth and wire/riser characteristics) and the pipe string (depending on depth, pipe characteristics etcetera).

The invention claimed is:

1. An offshore drilling system for performing subsea wellbore related activities involving a riser extending between a vessel and a subsea wellbore, the offshore drilling system comprising a drilling vessel with:

a floating hull comprising a moonpool;

a drilling tower positioned on said hull at or near the moonpool;

a tubular string main hoisting device comprising:

a main hoisting winch and a main cable driven by said main hoisting winch;

a crown block;

a travelling block suspended from said crown block via said main cable, the travelling block being configured to suspend a tubulars string, therefrom along a firing line through said moonpool;

a vertically mobile working deck positioned above the moonpool and vertically movable with respect to the drilling tower along the firing line within a motion range including a heave compensation motion range;

a rig floor slip device arranged on said mobile working deck and configured to suspend therefrom the tubulars string along the firing line through said riser to the wellbore;

a telescopic joint for compensating the length of said riser, the telescopic joint comprising an outer barrel configured to be connected to a fixed length section of the riser, and an inner barrel movable relative to the outer barrel;

a diverter configured to divert a hydrocarbon and/or drilling mud stream flowing up through the riser; wherein the inner barrel of the telescopic joint is secured to the diverter via a flexible joint;

a riser tensioning system comprising a tension ring connected to the fixed length section of the riser or to the outer barrel of the telescopic joint, and tension members connected to said tension ring and to the floating hull; and an integrated heave compensation system configured to provide a heave compensation of the travelling block as well as of the mobile working deck, such that, in operation, said travelling block and the mobile working deck move synchronously in heave compensation, wherein in an operational modus:

the diverter is connected stationary to the floating hull; and a mechanical connector is tensioned between the fixed length section of the riser or to the outer barrel of the telescopic joint on the one end, and the mobile working deck.

2. The offshore drilling system according to claim 1, wherein a diverter carrier is provided for the diverter, allowing the diverter to move between the operational position and a moonpool clearance position.

3. The offshore drilling system according to claim 2, wherein in the moonpool clearance position the diverter carrier is releasably attached to the mobile working deck, allowing the diverter to be brought in an elevated position above the moonpool.

4. The offshore drilling system according to claim 1, wherein the integrated heave compensation system comprises:

a main cable heave compensation sheave in a path of said main cable between said main hoisting winch and the travelling block, and wherein the heave compensation system comprises a hydraulic sheave compensator connected to said main cable heave compensation sheave to provide a heave compensated motion of the travelling block; and a hydraulic deck compensator, the hydraulic deck compensator being connected to the hull and to the mobile working deck to provide a heave compensated motion of the working deck relative to the hull within said heave compensation motion range, wherein the heave compensation system is configured such that, in operation, said hydraulic deck compensator and said hydraulic sheave compensator move synchronously in order to provide heave compensation of both the travelling block and the mobile working deck.

5. The offshore drilling system according to claim 4, wherein the hydraulic deck compensator comprises a pair of hydraulic cylinders positioned at opposite sides of the firing line, and being spaced apart to allow for a passage of the riser section in the firing line and between said pair of hydraulic cylinders.

6. The offshore drilling system according to claim 1, wherein the integrated heave compensation system comprises a heave compensation system for the travelling block and a mechanical connection between the travelling block and the mobile working deck to provide a heave compensated motion of the working deck relative to the drilling tower structure.

7. The offshore drilling system according to claim 6, wherein the integrated heave compensation system comprises a hydraulic main cable compensator engaging on the one or more main cables and configured to provide a heave compensated motion of the travelling block, such that, in operation, said hydraulic main cable compensator provides heave compensation of both the travelling block and the mobile working deck.

8. The offshore drilling system according to claim 1, wherein the mechanical connector is one or more of a cable, a chain, a rigid link, and a hydraulic cylinder.

9. The offshore drilling system according to claim 1, wherein the motion range includes a lower stationary position, and wherein the heave compensation motion range lies higher than said lower stationary position.

10. The offshore drilling system according to claim 1, further comprising at least one of the following features:

the floating hull further comprising a drillers cabin deck and a drillers cabin thereon, with the lower stationary position of the working deck being at said drillers cabin deck level;

a piper racker system provided with a heave motion synchronisation system configured to bring a drill pipe retrieved from a drill pipe storage rack into a vertical relative motion synchronous with a relative motion of the upper end of the riser, thereby allowing to interconnect the drill pipe to the tubulars string suspended from the rig floor slip device; and a rotating control device (RCD), to close off an annulus between an upper riser section and the tubulars string extending through the riser, and including at least one flowhead member to allow a connection of at least one hose for transferring an annular fluid flow to the floating hull.

11. A method for performing subsea wellbore related activities involving a riser extending between a vessel and a subsea wellbore, comprising the step of using the offshore drilling system according to claim 1.

12. An offshore drilling system for performing subsea wellbore related activities involving a riser extending between a vessel and a subsea wellbore, the offshore drilling system comprising:

a floating hull comprising a moonpool;

a drilling tower positioned on said hull at or near the moonpool;

a tubular string main hoisting device comprising:

a main hoisting winch and a main cable driven by said main hoisting winch;

a crown block; and a travelling block suspended from said crown block via said main cable, the travelling block being configured to suspend a tubulars string therefrom along a fitting line extending through said moonpool;

a vertically mobile working deck positioned above the moonpool and vertically movable with respect to the drilling tower along the firing line within a motion range including a heave compensation motion range;

a mobile working deck support cylinder, the support cylinder being connected to the vessel and to the mobile working deck to vertically move the working deck relative to the vessel, within the motion range including the heave compensation motion range, a heave compensation system configured to provide heave compensation of the travelling block as well as of the mobile working deck, the heave motion compensation system comprising:

a heave compensation cylinder, the heave compensation cylinder being connected to a gas buffer for providing the main hoisting device with passive heave compensation; and a sheave head, comprising one or more sheaves engaging the main cable of the main hoisting device, wherein the sheave head is supported by a piston of the heave compensation cylinder for movement along a heave compensation trajectory, wherein the mobile working deck support cylinder is hydraulically connected with the heave compensation cylinder of the heave compensation system, such that in operation the mobile working deck support cylinder moves synchronously with the heave compensation cylinder of the heave compensation system, and thus the mobile working deck moves synchronously with the travelling block; and a mobile working deck dynamic positioning system, for moving the mobile working deck along the firing line within the motion range including the heave compensation motion range, wherein the mobile working deck positioning system comprises:

a positioning winch with an associated positioning cable;

a control device, the control device being configured to control the speed of the positioning winch; and one or more sheaves, the sheaves guiding the positioning cable in a loop along the heave compensation trajectory, wherein the positioning cable is connected to the piston of the heave compensation cylinder and/or the sheave head of the heave compensation cylinder, such that the positioning winch can pull the piston of the heave compensation cylinder in opposite directions along the heave compensation trajectory and, and thus position the mobile working deck with the mobile working deck support cylinder that is hydraulically connected to the heave compensation cylinder.

13. The offshore drilling system according to claim 12, wherein the control device of the mobile working deck positioning system is connected with, and configured to control, the main hoisting winch, to enable the control device to use the main hoisting system to position and/or move the travelling block while pulling the rod of the heave compensation cylinder.

14. The offshore drilling system according to claim 12, wherein the dynamic positioning system is configured to adjust passive heave compensation of the travelling block as well as of the mobile working deck by increasing and/or lowering the speed at which the piston of the heave compensation cylinder moves along the heave compensation trajectory while the heave compensation system provides passive heave compensation.

15. The offshore drilling system according to claim 12, wherein the dynamic positioning system is configured to register and/or predict heave, and is configured to provide active heave compensation of the travelling block as well as of the mobile working deck by pulling the piston of the heave compensation cylinder in opposite directions along the heave compensation trajectory.

16. The offshore drilling system according to claim 12, wherein the system is configured to block the hydraulic communication between the heave compensation cylinder and the mobile working deck support cylinder, to enable the mobile working deck positioning system to move the travelling block only.

17. The offshore drilling system according to claim 12, wherein the heave compensation system further comprises:

a sheave head track, extending parallel to the heave compensation trajectory;

a trolley, the trolley being coupled to the piston of the heave compensation cylinder, via a connector device and is coupled to the adjusting winch via the adjusting wire; and a trolley track, the trolley track extending parallel and adjacent to the heave compensation trajectory.

18. The offshore drilling system according to claim 12, wherein the vertically mobile working deck is vertically mobile within the motion range including a lower stationary position, wherein the working deck is used as stationary drill floor deck with a slip joint unlocked, the motion range further including the heave compensation motion range, wherein the working deck can perform heave compensation motion relative to the hull of the vessel, the heave compensation motion range lying higher than said lower stationary position.

19. A method for performing wellbore related activities, comprising the step of using the offshore drilling system according to claim 12.

20. The method according to claim 19, further comprising the step of:

positioning the mobile working deck relative to the vessel, by moving the mobile working deck along the firing line within the motion range, using the mobile working deck dynamic positioning system.

21. The method according to claim 19, further comprising the step of:

providing the mobile working deck with active heave compensation by moving the mobile working deck along the firing line within the heave compensation motion range, using the mobile working deck dynamic positioning system.

* * * * *